US011597583B2

(12) United States Patent
Pawlik et al.

(10) Patent No.: US 11,597,583 B2
(45) **Date of Patent: *Mar. 7, 2023**

(54) METHODS AND SYSTEMS FOR CONTROLLING AND MAINTAINING THE TEMPERATURE OF A DRINK WITHIN A DRINKING VESSEL

(71) Applicant: VoChill LLC, Austin, TX (US)

(72) Inventors: Randall Pawlik, Austin, TX (US); Lisa Pawlik, Austin, TX (US)

(73) Assignee: VoChill Inc., Austin, TX (US)

( * ) Notice: Subject to any disclaimer, the term of this patent is extended or adjusted under 35 U.S.C. 154(b) by 178 days.

This patent is subject to a terminal disclaimer.

(21) Appl. No.: 17/166,523

(22) Filed: Feb. 3, 2021

(65) Prior Publication Data

US 2021/0155394 A1 May 27, 2021

Related U.S. Application Data

(63) Continuation of application No. 16/023,341, filed on Jun. 29, 2018, now Pat. No. 10,947,026.

(51) Int. Cl.

| | |
|---|---|
| ***B65D 81/38*** | (2006.01) |
| ***A47G 19/22*** | (2006.01) |
| ***A47G 23/02*** | (2006.01) |

(52) U.S. Cl.

CPC ..... *B65D 81/3886* (2013.01); *A47G 19/2288* (2013.01); *A47G 23/0208* (2013.01);

(Continued)

(58) Field of Classification Search

CPC ..... A47G 23/0216; A47G 19/2288; A47G 23/02; A47G 23/0208; B65D 81/3883; B65D 81/3881; F25D 2331/808

(Continued)

(56) References Cited

U.S. PATENT DOCUMENTS

| | | | |
|---|---|---|---|
| 556,337 | A | 3/1896 | Dawes |
| 1,986,958 | A | 1/1935 | Abraham |

(Continued)

FOREIGN PATENT DOCUMENTS

| | | |
|---|---|---|
| DE | 29913627 | 8/1999 |
| EP | 3048007 | 7/2016 |

(Continued)

OTHER PUBLICATIONS

Universal Drink Holder; https://www.amazon.com/beverage-universal-attached-wheelchairs-walkers/dp/B0062BU3J4, 6 pages, Web accessed on Mar. 28, 2018.

(Continued)

*Primary Examiner* — John K Fristoe, Jr.
*Assistant Examiner* — Jennifer Castriotta
(74) *Attorney, Agent, or Firm* — Baker Botts L.L.P.

(57) ABSTRACT

Disclosed herein are systems for controlling and maintaining the temperature of a drink. The system may include a receptacle defining a recess for receiving a drinking vessel. The system may have a stand for holding the receptacle upright. The stand may be releasably attached to the receptacle. The receptacle may include a top end portion, a bottom end portion, an inner wall portion, and an outer wall portion. The top end portion may define a top opening of the recess. A system may include a first receptacle defining a first recess for receiving a drinking vessel. The system may include a second receptacle for receiving a drinking vessel, wherein the second receptacle defines a second recess. The system may include a first stand operable to releasably attach to the first receptacle and the second receptacle. Also disclosed are methods for controlling and maintaining the temperature of a drink.

20 Claims, 22 Drawing Sheets

(52) U.S. Cl.
CPC ..... *A47G 23/0216* (2013.01); *B65D 81/3881* (2013.01); *B65D 81/3883* (2013.01); *F25D 2331/808* (2013.01)

(58) Field of Classification Search
USPC ..... 220/739, 903
See application file for complete search history.

(56) References Cited

U.S. PATENT DOCUMENTS

| | | | |
|---|---|---|---|
| 2,169,426 | A | 8/1936 | Morton |
| 2,657,891 | A | 11/1953 | Haften et al. |
| 4,726,553 | A | 2/1988 | Wischusen, III |
| 4,831,842 | A | 5/1989 | Kelley et al. |
| 4,852,843 | A | 8/1989 | Chandler |
| 4,961,555 | A | 10/1990 | Egan, Jr. |
| 4,986,089 | A | 1/1991 | Raab |
| 4,989,418 | A | 2/1991 | Hewlett |
| 5,147,067 | A | 9/1992 | Effertz |
| 5,207,076 | A | 5/1993 | Sciarrillo |
| 5,397,089 | A | 3/1995 | Kataoka |
| 5,579,949 | A | 12/1996 | Dykes et al. |
| 5,680,944 | A | 10/1997 | Rueter |
| 5,845,804 | A | 12/1998 | Prescott |
| 5,915,580 | A | 6/1999 | Melk |
| 5,960,984 | A | 10/1999 | Weston |
| 6,059,138 | A | 5/2000 | Labruyere |
| 6,073,796 | A | 6/2000 | Mogil |
| 6,405,892 | B1 | 6/2002 | Volan |
| 6,425,494 | B1 | 7/2002 | Woods, II |
| 6,575,417 | B1 | 6/2003 | Krommenakker |
| 7,000,801 | B2 | 2/2006 | Rodriguez |
| 7,516,931 | B2 | 4/2009 | Sarullo |
| 2002/0130236 | A1 | 9/2002 | Swensen |
| 2003/0085233 | A1 | 5/2003 | Winkleman |
| 2004/0200739 | A1 | 10/2004 | Escobar |
| 2005/0082302 | A1 | 4/2005 | Fischer |
| 2007/0125791 | A1 | 6/2007 | Donnelly et al. |
| 2009/0071581 | A1 | 3/2009 | Britt et al. |
| 2009/0294463 | A1 | 12/2009 | Stack |
| 2010/0206920 | A1 | 8/2010 | Byrns et al. |
| 2012/0091296 | A1 | 4/2012 | Lee |
| 2015/0342382 | A1 | 12/2015 | D'Alesio |
| 2016/0023585 | A1 | 1/2016 | Salter et al. |

FOREIGN PATENT DOCUMENTS

| | | |
|---|---|---|
| GB | 2436677 | 10/2007 |
| WO | 1995030865 | 11/1995 |
| WO | 2010149171 | 12/2010 |
| WO | 2013/057341 | 4/2013 |

OTHER PUBLICATIONS

Duro-Med Wheelchair Cup Holder—Walker Cup Holder, Universal, Black; https://www.amazon.com/Duro-Med-Wheelchair-Cup-Holder-Universal/dp/B000EWXSUI/red=pd_lpo_vtph_121_bs_1?_, 8 pages, Web accessed on Mar. 28, 2018.

Attwood Standard Beverage Holder; https://www.amazon.com/attwood-11670-4-Attwood-Standard-Beverage/dp/B0001O0D6CY/ref=pd_bxgy_200_img_2?_encoding=, 7 pages, Web Accessed on Mar. 28, 2018.

Cup Holder, 360° Rotating,Drink Bottle Cup,Stroller Cup Holder,BIcycle Bike Water Bottle Cage Holder; https://www.amazon.com/dp/B0732K39DX/ref=sspa_dk_detail_3?psc=1, 6 pages, Web accessed on Mar. 28, 2018.

METHODS AND SYSTEMS FOR CONTROLLING AND MAINTAINING THE TEMPERATURE OF A DRINK WITHIN A DRINKING VESSEL

CROSS-REFERENCE TO RELATED APPLICATIONS

This application is a continuation of U.S. application Ser. No. 16/023,341 filed Jun. 29, 2018, the contents of which is incorporated by reference herein in its entirety.

FIELD OF THE DISCLOSURE

The present disclosure relates to methods and systems for controlling and maintaining the temperature of a drink within a drinking vessel.

BACKGROUND

As a drink sits in a drinking vessel, the temperature of the drink rises or falls to ambient temperature instead of being maintained at, or changed to, a desired drinking temperature. Devices have been developed to maintain the temperature of a drink. One class of devices maintains a drink temperature by being inserted into the contents of the drinking vessel. Another class maintains temperature through beverage jackets (e.g., koozie, hugger, coozie). Another class is a specialized drinking vessel that itself is thermally insulated to maintain the temperature of the drink (e.g., tumbler or frozen glass). Another class includes tabletop containers that can chill a bottle of wine.

SUMMARY

Disclosed herein are systems for controlling and maintaining the temperature of a drink. An exemplary system includes a receptacle defining a recess for receiving and holding a drinking vessel. The receptacle includes a top end portion, a bottom end portion, an inner wall portion, and an outer wall portion. The top end portion defines a top opening of the recess. A user can warm or cool the receptacle before using the receptacle to hold the drinking vessel. The cooled or warmed receptacle, by holding and contacting the drinking vessel, transfers thermal energy to, or receives thermal energy from, the drinking vessel. The system thereby allows a user to enjoy a drink at a desired temperature for an extended period of time.

An exemplary system includes a stand for holding the receptacle upright. A user may use a drinking vessel with a stem for its aesthetic quality, to avoid putting fingerprints on the bowl of the glass, or to avoid warming the drink with body heat. The stand allows the system to be used with drinking vessels that have stems. The stand is releasably attachable to the receptacle so that a user may store only the receptacle in a cooling or heating environment, such as a freezer, thereby saving space in the cooling or heating environment. Detachability also allows a user to heat or cool one drinking vessel while another receptacle is stored in the freezer, for example. Detachability also allows the stand to remain at a comfortable temperature for the user to handle.

Since a user may wish to enjoy different drinks out of different drinking vessels, a system that can be used with different-shaped drinking vessels is desired. For example, a user may wish to enhance the drinking experience by drinking red wine out of a red wine glass and white wine out of a white wine glass. In an exemplary system, a user can use the system to heat or cool a variety of different drinking vessels with different shapes. The system includes an inner wall portion that includes a multivessel contour. The multivessel contour allows the system's cooled or heated receptacle to contact a larger surface area of numerous types of different-shaped drinking vessels. Contact with a larger surface area allows for more efficient transfer of thermal energy and thereby more effective temperature control and maintenance. The multivessel contour includes a top incline having a top slope and a middle incline having a middle slope. The magnitude of the middle slope is less than the magnitude of the top slope. The multivessel contour includes a bottom incline connected to the middle incline. The multivessel contour includes a curved surface connecting the top incline to the middle incline. The system may be modular and include multiple receptacles with the same or different multivessel contours.

An exemplary system includes a receptacle with a bottom end portion that defines a bottom opening of a recess. The bottom opening allows for the system to be better used with a stemmed drinking vessel such that the receptacle holds the bowl of the drinking vessel and the stem extends through the bottom opening. The receptacle of the system defines a side opening that extends laterally from the inner wall portion to the outer wall portion and vertically from a top opening of the recess to the bottom opening of the recess. The side opening allows a user to more easily place a drinking vessel in the receptacle and remove the drinking vessel from the receptacle. The side opening also enhances a user's enjoyment of a drink as it allows the user to view the drink.

To allow for better and longer-lasting heating and cooling, an exemplary system includes a receptacle that defines a closed inner cavity housed within the receptacle. The inner cavity carries and contains a thermal material. The thermal material may include a solid, gas, or liquid that is operable to resist changes in temperature so as to help maintain a previously established temperature. The inner cavity includes expansion space. When placed in a freezer or microwave, for example, a liquid solution may expand. A bottom end portion of the receptacle defines a bottom boundary of the inner cavity. A top end portion of the receptacle defines a top boundary of the inner cavity. An inner wall portion of the receptacle defines an inner boundary of the inner cavity. The outer wall portion defines an outer boundary of the inner cavity.

In an exemplary system, the system includes multiple stands for different purposes. The stands have a common attachment shape to attach to a receptacle so that each stand can be interchangeably used with the same receptacle. The system includes a stand that is elongated and has a foot to contact a supporting surface thereby holding the stand upright. The stand includes two stand prongs and extends radially outward from the receptacle.

An exemplary system includes a stand that is elongated and has a pointed end. The pointed end may be inserted into a soft surface to hold the receptacle upright outdoors, for example.

The receptacle can removably fit within the stand in an exemplary system. Such a configuration allows the stand to shroud the receptacle and drinking vessel, allowing for better temperature control and maintenance. The stand includes an evacuated chamber to insulate the receptacle, thereby further controlling the temperature of a drink within a drinking vessel.

An exemplary system is modular and includes multiple interchangeable receptacles. The system includes a first receptacle defining a first recess, the first receptacle including a top end portion, a bottom end portion, an inner wall portion, and an outer wall portion. The system includes a second receptacle defining a second recess. The first receptacle and second receptacle have a common attachment shape, so each receptacle may be used with the same one or more stands. While one receptacle is in use maintaining and controlling the temperature of a drinking vessel, another receptacle may be in a cooling or heating environment. When the user is ready for a second drink, the user can remove the additional receptacle from the cooling or heating environment and attach the cooled or heated receptacle to the stand. The user can place the, now unused, receptacle into the cooling or heating environment. The system can include any number of receptacles and stands. Each time the user wants a drink, the user can use a cooled or heated receptacle to maintain and control the temperature of the user's drink.

An exemplary system includes a canister so that a user may simultaneously control the temperature of a bottle or other drinking vessel. The canister receives a bottle in a canister recess. Stands are mounted on the canister and can releasably attach to receptacles.

An exemplary modular system includes multiple interchangeable stands. The system includes a first stand operable to releasably attach to the first receptacle to hold the first receptacle upright. The system's stands have a common attachment shape and the system's receptacles have a common attachment shape. The first stand is operable to releasably attach to a second receptacle to hold the second receptacle upright.

An exemplary modular system includes a rack for carrying multiple receptacles, stands, drinking vessels, or a combination thereof. The rack includes a tray including a first tray side and a second tray side. The rack includes a first arm attached to the tray at the first tray side. The first arm includes a track. The rack includes a second arm attached to the tray at the second tray side. The rack is foldable to allow a user to store the rack in a smaller space. The second arm includes a wheel operable to slide in the track thereby folding the rack.

An exemplary modular system includes multiple receptacles that are differently shaped. Different-shaped receptacles are one way the system can be used with a variety of drinking vessels with different shapes. A first receptacle of the system defines a first recess such that the first recess has a different shape than a second recess of a second receptacle. Each receptacle may have a common attachment shape, so each receptacle can be interchangeably used with the system's stands. The stands have a common attachment shape that compliments each receptacle's common attachment shape. The system includes a second stand operable to releasably attach to the first receptacle to hold the first receptacle upright. The second stand is operable to releasably attach to the second receptacle to hold the second receptacle upright. Although the second stand and the first stand include a common attachment shape, the second stand may include a shape different than the first stand. Any number of stands and receptacles may be used in the modular system.

Disclosed herein are methods for controlling and maintaining the temperature of a drink. The methods offer numerous advantages. For example, the methods may allow a user to save space in their freezer and to control the temperature of a drink while using a desired drinking vessel. An exemplary method includes placing a receptacle in a cooling environment characterized by a cooling temperature, where the cooling temperature is below room temperature. The method includes removing the receptacle from the cooling environment. The method includes releasably attaching a stand to the receptacle. The method includes standing the receptacle upright. The method includes pouring a drink into a drinking vessel. The method includes placing the drinking vessel in a recess of the cooled receptacle while the receptacle is standing upright. The method includes enclosing a solution in an inner cavity of the receptacle prior to the step of cooling the receptacle.

BRIEF DESCRIPTION OF THE DRAWINGS

For a more complete understanding of the present disclosure and its features and advantages, reference is now made to the following description, taken in conjunction with the accompanying drawings, which depict various embodiments of the disclosure.

DETAILED DESCRIPTION

In the following description, details are set forth by way of example to facilitate discussion of the disclosed subject matter. It should be apparent to a person of ordinary skill in the field, however, that the disclosed embodiments are exemplary and not exhaustive of all possible embodiments.

As will be described in further detail, the inventors of the present disclosure have developed systems and methods for controlling and maintaining the temperature of a drink within a drinking vessel. The systems and methods may allow for better and more convenient temperature control of the drink and thereby better enjoyment of the drink by a user.

Figure 1A:
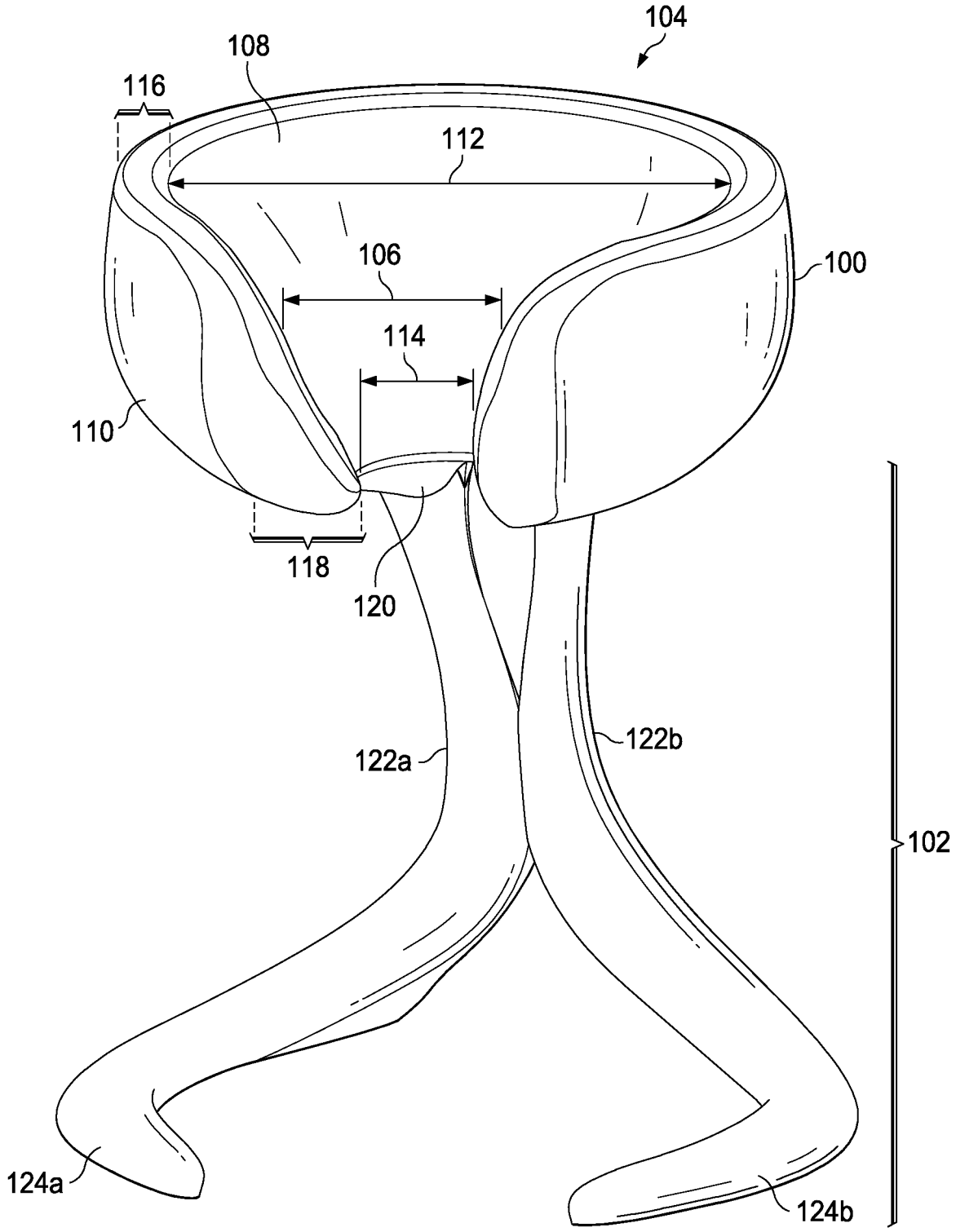
FIG. 1A is a schematic diagram of a system for controlling the temperature of a drink, the system including a receptacle releasably attached to a stand.

A user may pour a drink into a drinking vessel and use the system to maintain and control the temperature of the drink. In one example of a system, the system includes a receptacle and a stand. A user may cool or warm the receptacle by placing the receptacle in a freezer or microwave, for example. After waiting for the receptacle to reach a temperature, the user can remove the cooled or warmed receptacle and use the receptacle to hold a drinking vessel containing a drink. As the receptacle holds the drinking vessel, thermal energy is transferred from the drinking vessel to the cooled receptacle or from the heated receptacle to the drinking vessel. The receptacle, by holding the drinking vessel and transferring thermal energy, cools or warms the drinking vessel and maintains and controls the drink's temperature, prolonging the time the drink is cool or warm. The receptacle may be releasably attached to the stand to enable the receptacle to hold, for example, a stemmed wine glass. FIG. 1A depicts such a system, where a user can control the temperature of a drink within a drinking vessel by placing the drinking vessel in a cooled or warmed receptacle.

As shown by example in FIG. 1A, the system may include a receptacle 100 releasably attached to a stand 102. The receptacle 100 and stand 102 may be made from one or more of a variety of materials including plastic, wood, metal, ceramic, or a combination thereof and may include a textured surface to allow for easier grip. The receptacle 100 defines a recess 104 to receive and hold a drinking vessel. The recess formed by the receptacle 100 may take a variety of shapes and be contoured to define a recess to receive a variety of drinking vessels having different shapes.

In general, the receptacle 100 controls or maintains temperature by contacting a drinking vessel. By contacting the drinking vessel where the drinking vessel contains the drink, such as the lower part of the bowl of a wine glass, the receptacle 100 can efficiently enable the transfer of thermal energy between the heated or cooled receptacle 100 and the drink.

A side opening 106 may allow a drinking vessel such as a stemmed wine glass to be easily received and still securely held by the recess 104. The user may easily place a stemmed wine glass into the receptacle 100 by placing the stem of the wine glass through the side opening 106 and setting the bowl of the wine glass in the receptacle 100. The side opening 106 also allows parts of a drinking vessel to be viewed while the receptacle 100 holds the drinking vessel. As depicted in FIG. 1A, the side opening 106 may extend laterally from an inner wall portion 108 to an outer wall portion 110. As also shown by example in FIG. 1A, the side opening 106 may also extend vertically from a top opening 112, defined by a top end portion 116 of the receptacle 100, to a bottom opening 114, defined by a bottom end portion 118 of the receptacle 100. The outer wall portion 110 and inner wall portion 108 connect the top end portion 116 and bottom end portion 118. The side opening 106 allows the user to view their drink but is not so great in size as to let a drinking vessel fall through the receptacle 100 or to eliminate the temperature control and maintenance benefits of the system.

The bottom end portion 118 as shown in FIG. 1A is substantially C-shaped and defines a bottom opening 114 of the recess 104. The bottom opening 114 may be small enough such that a drinking vessel does not fall through the bottom opening 114, but large enough such that at least part of a stem of a drinking vessel may extend through the bottom opening 114.

The top end portion 116 as shown in FIG. 1A is also substantially C-shaped. As also shown by example in FIG. 1A, the top end portion 116 defines a top opening 112 of the recess 104. The top opening 112 may allow the recess 104 to receive a drinking vessel. As shown in FIG. 1A, the top opening 112 may have a larger cross-sectional area than the bottom opening 114.

One problem that may occur when a user drinks a cooled drink, or uses other temperature controlling systems, is that condensation accumulates on the drinking vessel or temperature controlling system. When the condensation accumulates, it may drip onto a user's hand, causing the user inconvenience. Moisture may also accumulate and drip onto a foot of a wine glass, for example. When the user drinks from the wine glass, the user may inadvertently pour the moisture from the foot of the wine glass onto the user or other undesired locations, such as the user's dinner plate. The system allows for enjoyment of a drink with reduced or eliminated condensation accumulating at undesired locations.

To reduce unwanted user contact with condensation, the bottom end portion 118 of the receptacle 100 includes a lip 120. The lip 120 is shown as the lowest point of receptacle 100. When condensation accumulates on the system or drinking vessel, it may sweat downward to the lip 120. As shown in FIG. 1A, the lip 120 is located away from the side opening 106 where the user may grab a drinking vessel and away from a location where the condensation will drip onto a stem of a wine glass, for example. As shown in FIG. 1A, the lip 120 is shaped as two or more peaks. The lip 120 is shaped to extend outwardly from the receptacle 100 or the stand 102. With the lip 120, condensation that sweats onto the drinking vessel or onto the user is reduced or eliminated.

With the lip 120, condensation may be redirected from the receptacle 100 to the stand 102 and down to the supporting surface upon which the stand 102 is placed. The system may be alternatively configured such that the lip 120 is shaped as a single peak, a ridge, a plurality of ridges, or a combination thereof. The lip 120 may also be part of the stand 102.

The system includes the stand 102 to hold the system upright, to allow use with stemmed drinking vessels, or both. The stand 102 is elongated so that a drinking vessel is lifted off a supporting surface. Although shown as elongated, the stand 102 may be substantially flat. The receptacle 100 may also have a flat bottom end portion such that the receptacle 100 may stand upright without a stand 102. As shown in FIG. 1A, the stand 102 holds the receptacle 100 upright with the top end portion 116 substantially above the bottom end portion 118. The stand 102 also has one or more stand prongs 122*a* and 122*b*. The stand prongs 122*a* and 122*b* extend radially outward from the receptacle 100 to provide a wide base and sturdiness to prevent the system or drinking vessel from toppling over. The stand 102 also has one or more feet 124*a* and 124*b* for contacting a surface. The feet 124*a* and 124*b* may contact the supporting surface, such as a tabletop or the ground, thereby holding the stand 102 upright.

The system shown in FIG. 1A offers many advantages over previous systems. One advantage of the system is that a user may control and maintain the temperature of their drink while using their own drinking vessel. The user does not have to drink out of a large or lesser quality drinking vessel, such as a bulky insulated container, which may control temperature but diminishes the drinking experience. Another advantage is that the drinking vessel and drink may be viewed while in use, as opposed to a system that prevents viewing, such as a koozie. Viewing a drink enhances the user's experience by allowing the user to enjoy the color of the drink, for example. An additional advantage of the system is that the user may fine-tune the temperature to their liking. For example, the user may simply lift their drinking vessel from the receptacle and hold or set the drinking vessel directly on a supporting surface to allow the drink to warm slightly. The user may place the drinking vessel in the receptacle as the user desires to fine-tune the temperature. When using a tumbler, instead of the system in FIG. 1A for example, the user may not simply remove the drink from a tumbler and place the drink back into the tumbler. A further advantage of the system shown in FIG. 1A is that it reduces the condensation that drips onto the user's hand. The system also is advantageous in that it is shaped to resist toppling over.

Figure 1B:
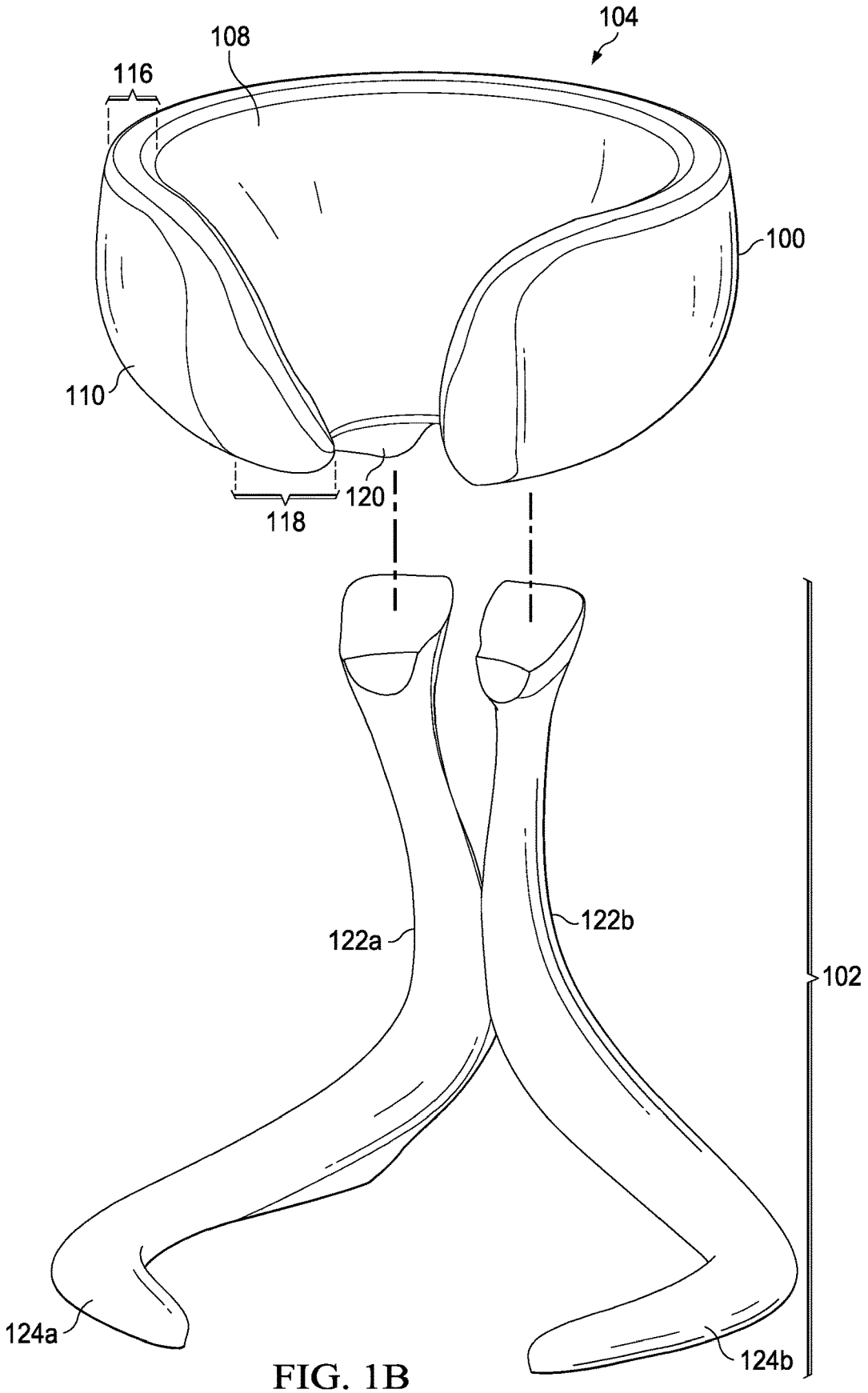
FIG. 1B is a schematic diagram of the system of FIG. 1A, with the receptacle detached from the stand.

One advantage of the system is that the system may include releasably attachable components. For example, FIG. 1B shows the system of FIG. 1A, with the receptacle 100 detached from the stand 102. When the system has a receptacle 100 that is detachable, a user may place only the receptacle 100 in a cooling environment (such as a freezer or refrigerator) or heating environment (such as an oven, microwave, or heat lamp) without the stand 102. The cooling environment and heating environment may be any environment where the temperature is below or above room temperature, respectively. A user may save space in the cooling or heating environment by detaching the stand 102 and placing only the receptacle 100 in the cooling or heating environment.

Detachability using a common attachment shape also allows for modularity, for example, a system where the stand 102 can releasably attach to numerous receptacles with the same or different shapes. Detachability allows one or more receptacles to be placed in a cooling or heating environment while another receptacle is in use, attached to the stand 102, or both. The user may detach a first receptacle from a stand and replace the first receptacle with a second receptacle that is cooled or heated. Therefore, a user may enjoy a first drink with the first receptacle and, when the user is ready for a second drink, the user may use a second receptacle that is already cooled or heated. The user can enjoy each drink at a desired temperature. Detachability also allows the stand to remain at a comfortable temperature for the user to handle. Detachability further allows modularity in that the receptacle 100 may be used with a plurality or variety of stands. The receptacle 100 may attach to the stand 102 by mating parts such as a pin and hole, magnets, a hinge, joint, or any other attachment mechanism. When the system has multiple receptacles or stands, some or all receptacles and some or all stands may have common attachment shapes, allowing for a system with interchangeable, modular parts. For example, every receptacle can include the same-shaped hole and every stand can include the same-shaped pin to connect to the hole. As an additional example, every receptacle may have a magnet with the same-shaped contacting surface and every stand may have a magnet with the same-shaped contacting surface. Detachability also allows for the receptacle 100 to be used with different-shaped stands, as described later. As also described later, detachability allows for a stand 102 to be used with different-shaped receptacles. In some systems, the receptacle 100 may be fixedly attached to the stand 102.

Figure 1C:
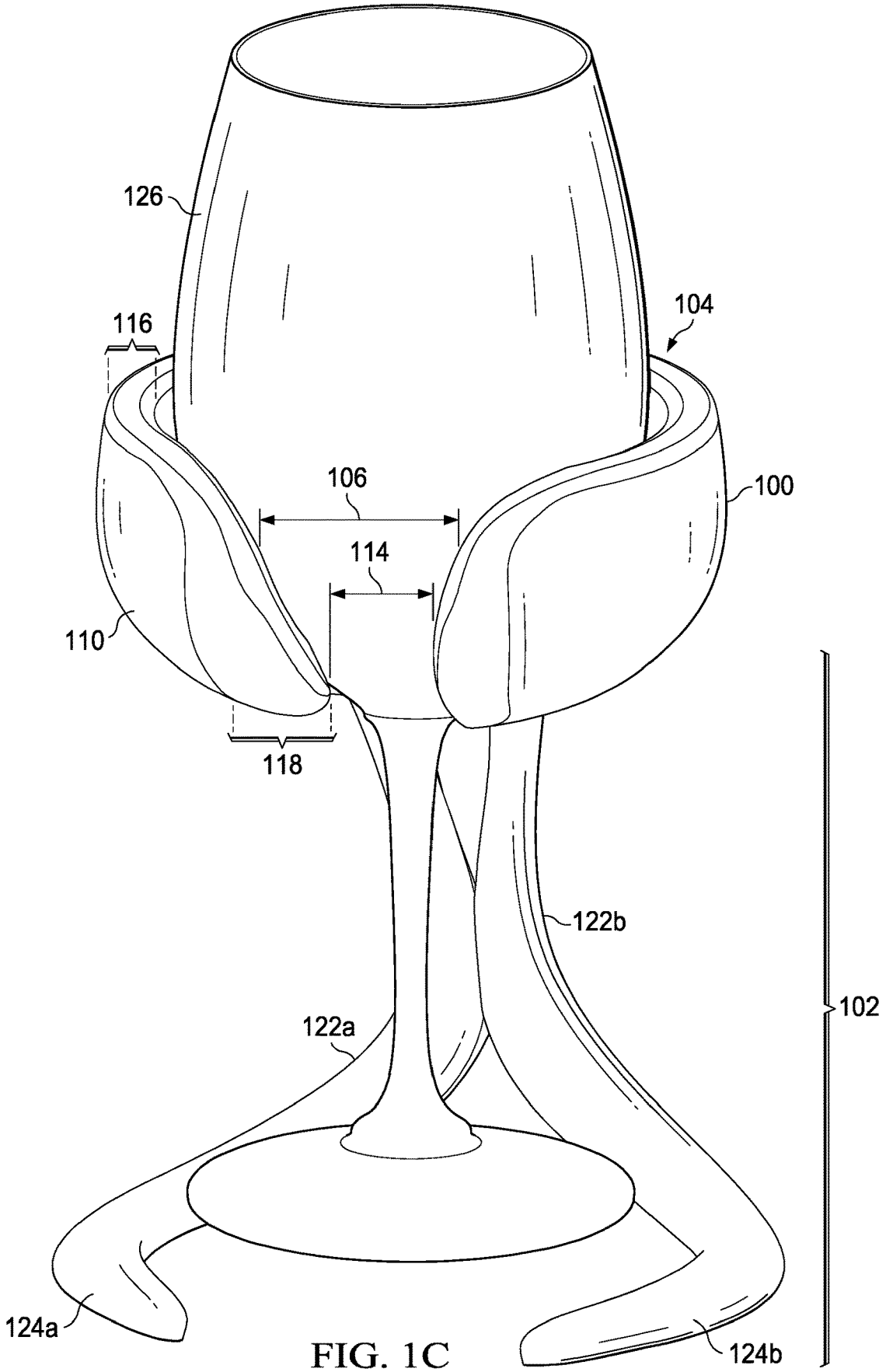
FIG. 1C is a schematic diagram of the system of FIG. 1A, with the receptacle holding a drinking vessel with a first shape.
Figure 2A:
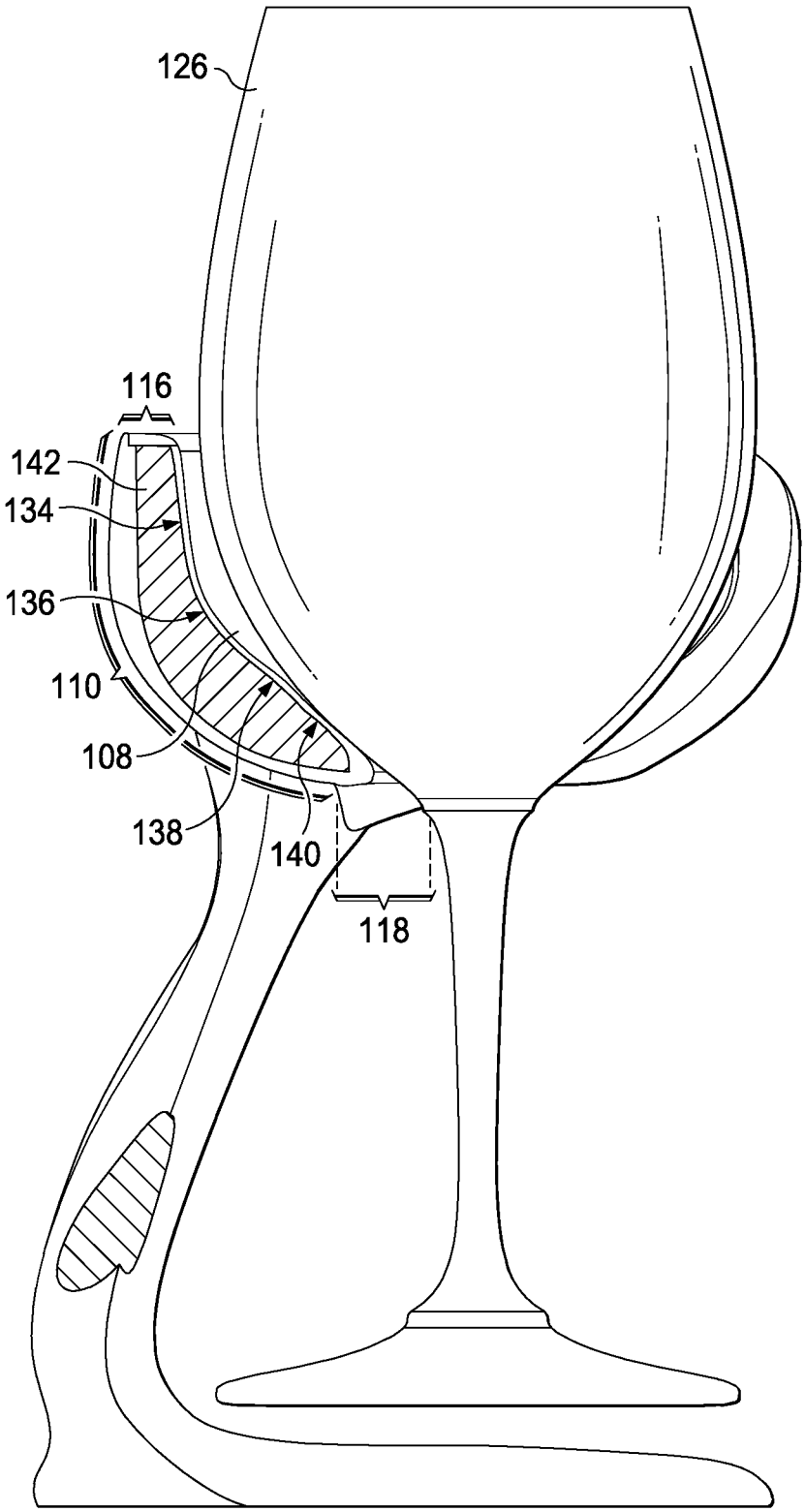
FIG. 2A is a schematic cross-sectional partial view of the receptacle of FIG. 1A holding the drinking vessel with the first shape of FIG. 1C.
Figure 2B:
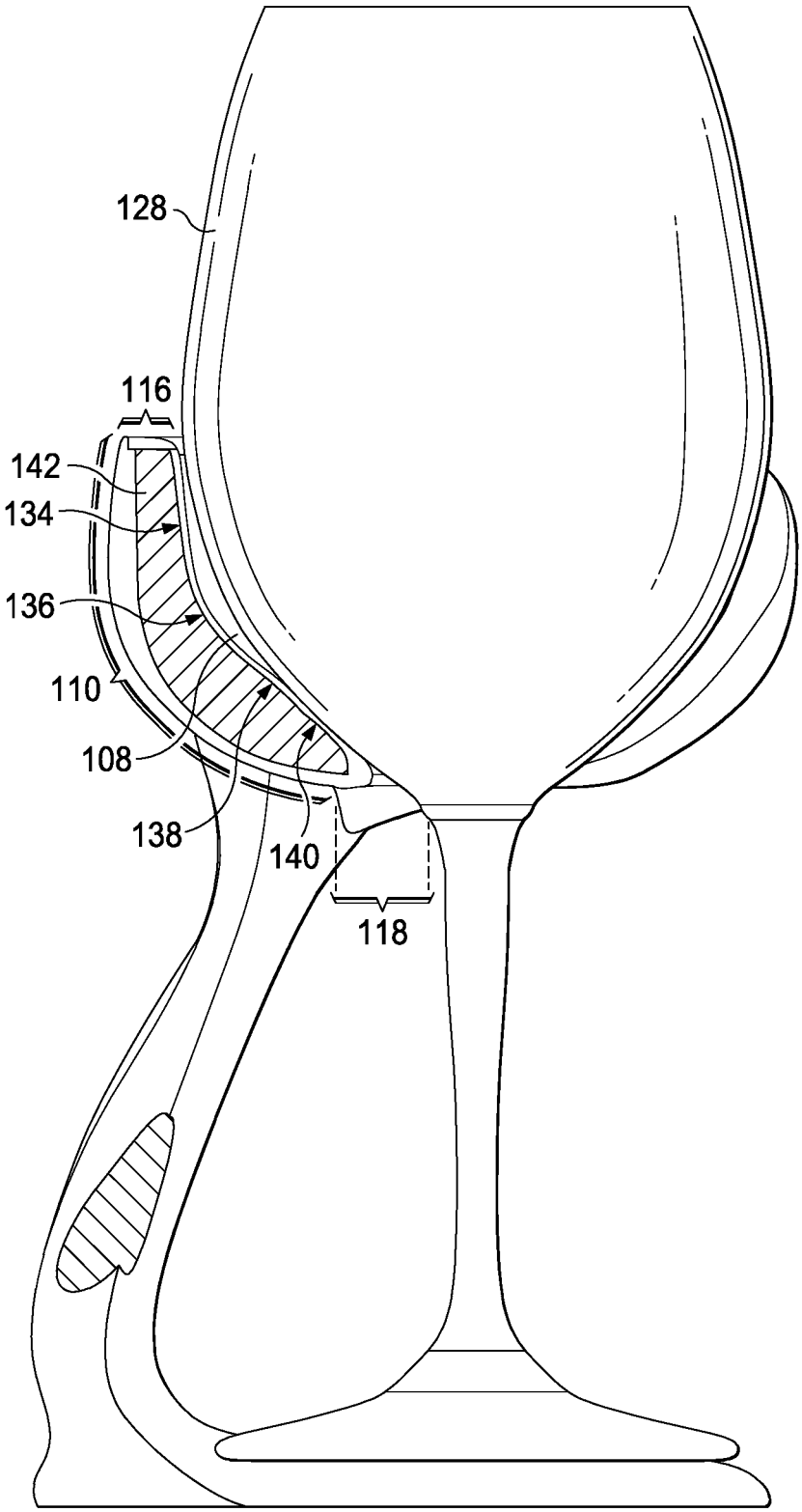
FIG. 2B is a schematic cross-sectional partial view of the receptacle of FIG. 2A holding a drinking vessel with a second shape.
Figure 2C:
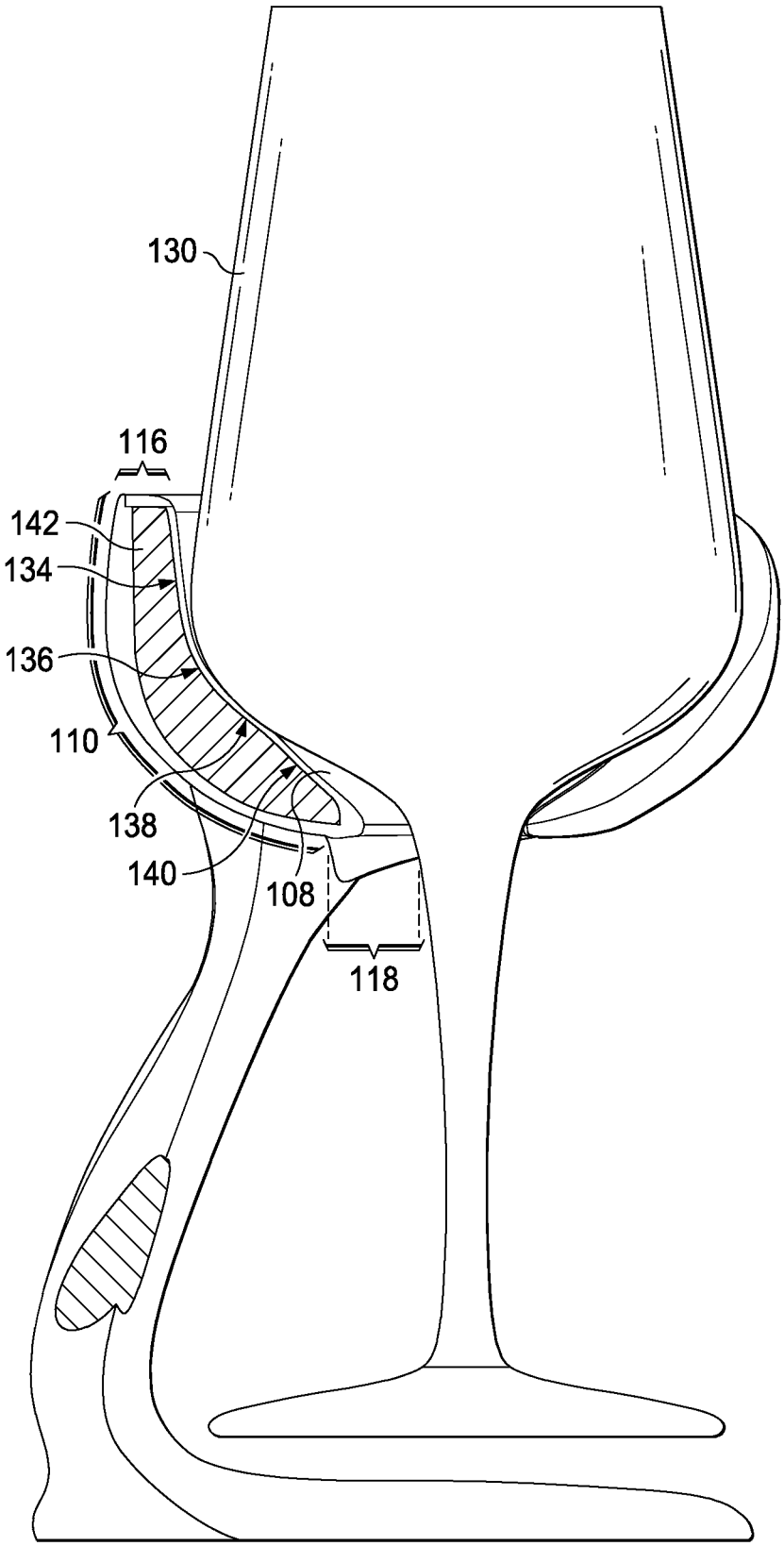
FIG. 2C is a schematic cross-sectional partial view of the receptacle of FIG. 2A holding a drinking vessel with a third shape.
Figure 2D:
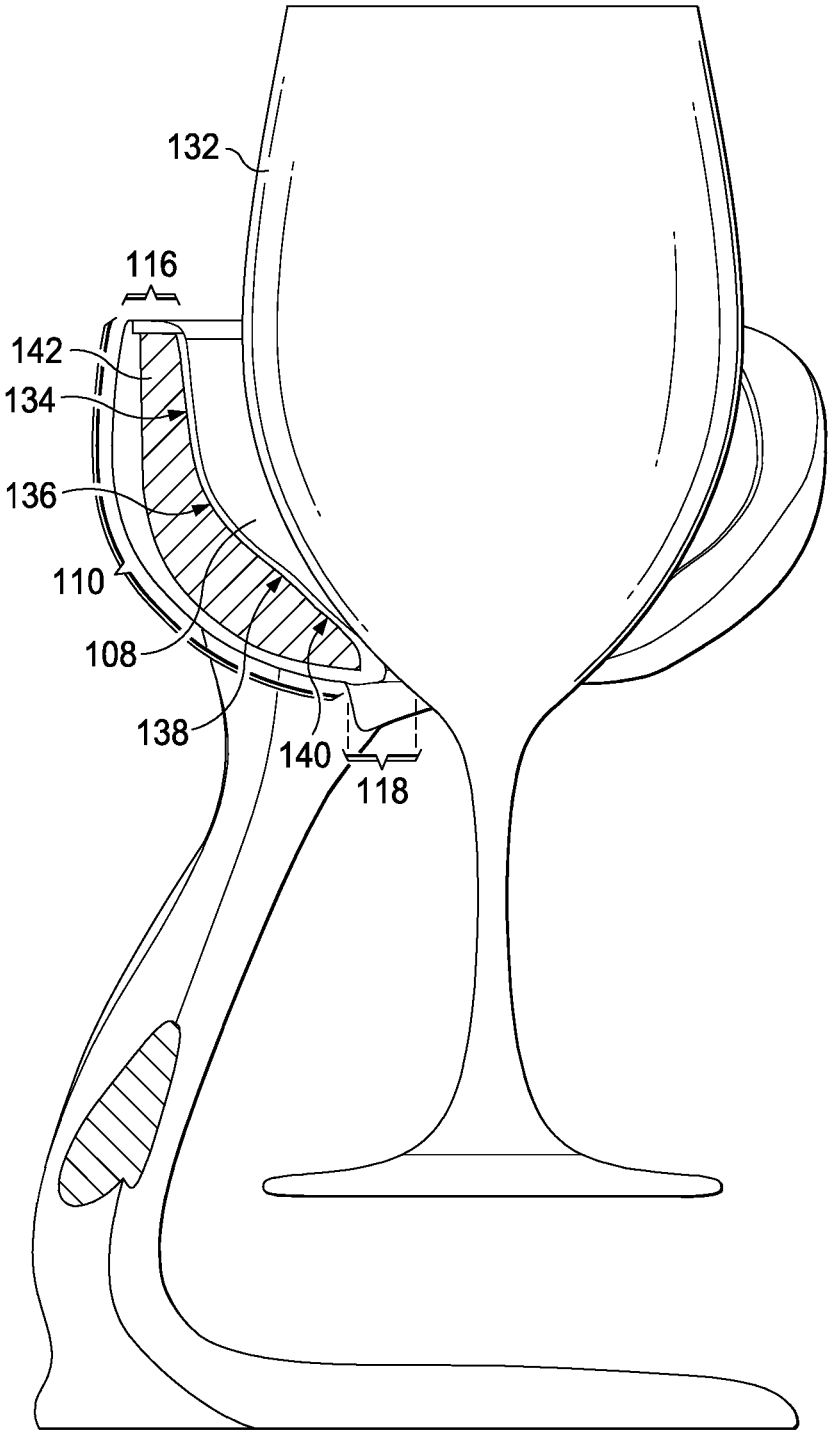
FIG. 2D is a schematic cross-sectional partial view of the receptacle of FIG. 2A holding a drinking vessel with a fourth shape.
Figure 2E:
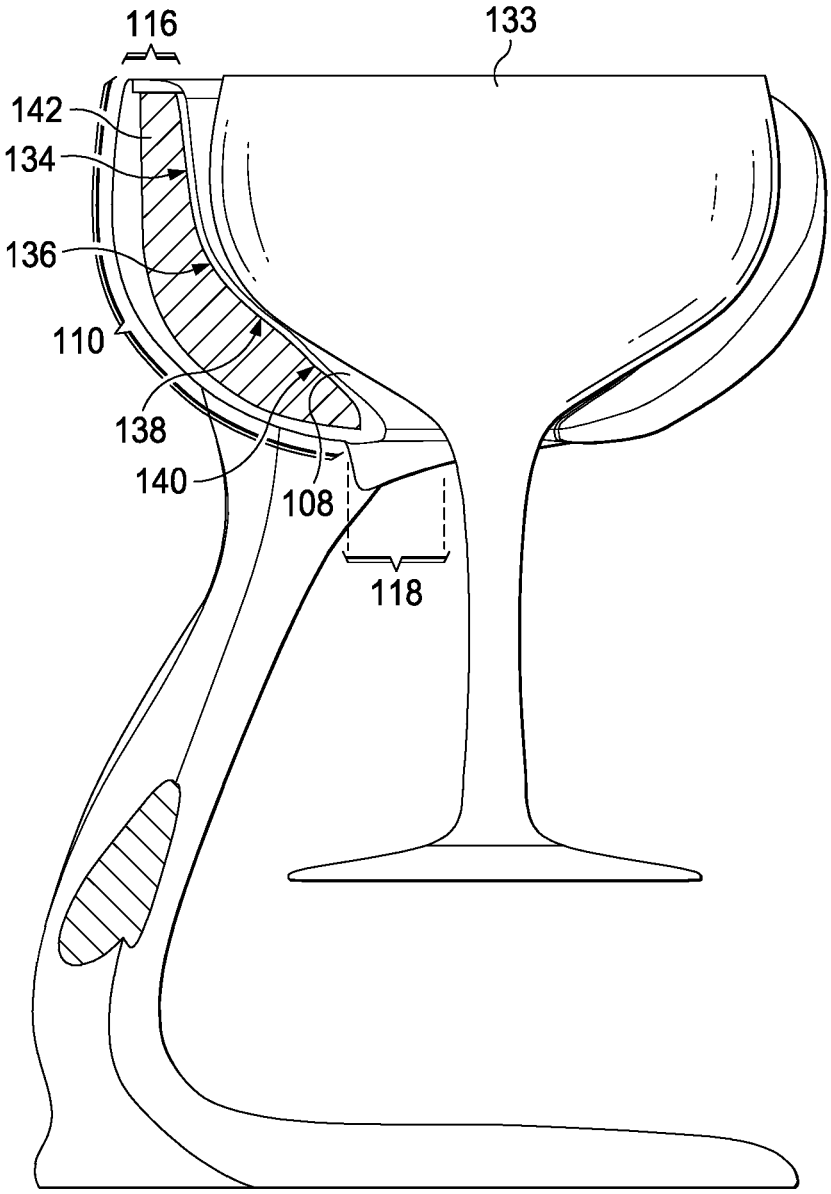
FIG. 2E is a schematic cross-sectional partial view of the receptacle of FIG. 2A holding a drinking vessel with a fifth shape.

As an example of how the system holds a drinking vessel, FIG. 1C depicts the system of FIGS. 1A and 1B holding a drinking vessel 126 with a first shape. After the receptacle 100 is removed from a cooling or heating environment, the receptacle 100 may be releasably but securely attached to the stand 102. The drinking vessel 126 may then be held by the receptacle 100, and the receptacle 100 may contact lower portions of the drinking vessel 126 nearest the drinkable fluid, thereby maintaining and controlling the drink's temperature efficiently.

As viewable in FIG. 1C, the top end portion 116 and bottom end portion 118 are substantially C-shaped about the drinking vessel 126. The bottom opening 114 is small enough such that the drinking vessel 126 does not fall through the bottom opening 114, but large enough such that the stem of the drinking vessel 126 extends through the bottom opening 114.

While holding the drinking vessel 126, at least part of the receptacle 100 may contact the drinking vessel 126 while the recess 104 of the receptacle 100 receives the drinking vessel 126. The contact of the drinking vessel 126 by the receptacle 100 allows the system to efficiently transfer thermal energy, thereby controlling and maintaining the temperature of the drinking vessel 126. The side opening 106 allows parts of the drinking vessel 126 to be viewed while the system holds the drinking vessel 126. The system need not have a side opening. Without the side opening 106, the system may even more efficiently control and maintain the temperature of a drink by fully enclosing the drinking vessel. But a system that allows a user to view the drink while enjoying the drink may enhance a user's experience. For example, the user may enjoy watching bubbles rise in their champagne. The user may enjoy viewing the caramel color of their scotch or the deep red of their Bordeaux. The side opening 106 also allows the stemmed drinking vessel 126 to be easily placed within and removed from the recess 104. The stand 102 may be elongated so that the drinking vessel 126 is lifted off a supporting surface as shown in FIG. 1C. A drinking vessel may need to be lifted off of a supporting surface if, for example, the drinking vessel has a stem.

The system as shown allows for use with a drinking vessel 126 designed to be used with a particular drink. The drinking vessel 126 is designed for red wine. A user may wish to enjoy a drink out of a drinking vessel designed for a particular drink. For example, the user may enjoy using a champagne flute for champagne as the champagne flute itself creates a long path for champagne bubbles to rise. A user may also wish to enjoy drinks out of glasses other than champagne flutes, such as a martini out of a coupe. As a further example, many wine glasses are shaped differently to direct the flow of a specific wine variety onto parts of the user's tongue or affect the aromas that a user smells. Drinking vessels may also have aesthetic qualities such as thin or decorative glass that is unmatched by bulky insulated containers. The system is advantageous in that it allows a user to enjoy a temperature-controlled drink out of the drinking vessel specifically designed for that drink.

The system also allows for controlling the temperature of a drink without inserting a foreign object into the drink itself. Such a foreign object may decrease enjoyment of the drink by adding weight to the drinking vessel, changing the feel of the drinking vessel, affecting taste and smell of the drink, causing unwanted contact of the user's lips or face with the foreign object, and decreasing the aesthetic value of a drinking vessel containing a drink. The system allows a user to enjoy drinking from a drinking vessel 126, while the drink's temperature is controlled and maintained, without diminishing the enjoyment of the drink with a foreign object. An additional advantage of the system is that the user may fine-tune the temperature to their liking. For example, the user may simply lift their drinking vessel from the receptacle and hold or set the drinking vessel directly on a supporting surface to allow the drink to warm slightly. In systems that use a foreign object placed within the drink contents, it may be difficult for a user to fine-tune the temperature of their drink because the user will have to insert their hand into the drink contents.

Although the drinking vessel 126 is shown having a first shape, the system may be used with a variety of drinking vessels with different shapes. The system may hold different-shaped drinking vessels, such as a red wine glass, a Bordeaux glass, a Burgundy glass, a white wine glass, a stemmed wine glass, a stemless wine glass, a round wine glass, a wine glass with angled edges, a champagne flute, a pint glass, a whiskey glass, a martini glass, a coupe glass, a glass with any variety of shapes, a can, a bottle, or any other vessel used to contain a drink. As will be described herein, the receptacle 100 can be shaped to provide surface-to-surface contact with numerous different-shaped drinking vessels. Another way the system can be used with different-shaped drinking vessels is by having numerous receptacles defining different recess for receiving a variety of different-shaped drinking vessels.

FIGS. 2A, 2B, 2C, 2D, and 2E provide examples of how the system of FIGS. 1A through 1C may be used with different-shaped drinking vessels. The receptacle 100 may define a recess that can receive a variety of different drinking vessels, such as the drinking vessel 126 with the first shape of FIG. 1C, shown in FIG. 2A. The recess may also receive a drinking vessel 128 with a second shape shown in FIG. 2B, a drinking vessel 130 with a third shape shown in FIG. 2C, a drinking vessel 132 with a fourth shape shown in FIG. 2D, and a drinking vessel 133 with a fifth shape shown in FIG. 2E. The drinking vessels 126, 128, 130, and 132 are wine glasses. The drinking vessel 133 is a coupe glass. The receptacle 100 may be shaped to allow for a large surface area of the inner wall portion 108 to contact drinking vessels of a variety of different shapes and sizes. Increased contact area allows more efficient temperature control because the thermal energy transfer is dependent on how much surface of the drinking vessel is contacted near the drink. In the exemplary embodiment shown in FIGS. 2A through 2E, the inner wall portion 108 is specially shaped with a multivessel contour to contact a large surface area of a variety of different-shaped drinking vessels near where the drink is contained.

An example of the multivessel contour is depicted in FIGS. 2A through 2E. At the top end portion 116, a top incline 134 has a top slope. "Slope" in this disclosure refers to the mathematical numerical descriptor. When the receptacle is sitting upright and is holding a drinking vessel, the top slope may have a magnitude such that the top incline 134 is nearly perpendicular to the supporting surface upon which the system stands. The top incline 134 contacts the drinking vessel 128 in FIG. 2B and contacts the drinking vessel 130 in FIG. 2C.

The inner wall portion 108 may also have a curved surface 136. The curved surface 136 may better accommodate drinking vessels that have wide bowls, angular edges, or both. The curved surface 136 connects the top incline 134 and a middle incline 138. The curved surface 136 is shown as having a smooth surface but may be jagged or may include a combination of smooth and jagged surfaces to more firmly hold a drinking vessel or to accommodate other drinking vessels. Although jagged surfaces may decrease surface area contact, jagged surfaces may prevent slippage. The curved surface 136 contacts the drinking vessel 130 in FIG. 2C and the drinking vessel 133 in FIG. 2E. The middle incline 138 may have a middle slope of less magnitude than the top slope of the top incline 134. The middle incline 138 accommodates drinking vessels that may curve inwardly towards the bottom of the bowl of the drinking vessel. The middle incline 138 contacts the drinking vessel 130 in FIG. 2C and the drinking vessel 133 in FIG. 2E. The middle incline 138 is connected to a bottom incline 140 at the bottom end portion 118. The bottom incline 140 may have a bottom slope of greater magnitude than the middle slope of the middle incline 138 and less magnitude than the top slope of the top incline 134. The bottom incline 140 allows for a larger surface area of the receptacle to contact narrow drinking vessels, for example. The bottom incline 140 contacts the drinking vessel 126 in FIG. 2A, the drinking vessel 128 in FIG. 2B, the drinking vessel 130 in FIG. 2C, the drinking vessel 132 in FIG. 2D, and the drinking vessel 133 in FIG. 2E.

The system is therefore advantageous over other systems as it can control the temperature of a variety of different drinking vessels with different shapes. FIGS. 2A through 2E provide five examples of how a receptacle with one shape can hold different-shaped drinking vessels to provide suitable surface area contact to provide thermal conduction. The system may also be configured such that the inner wall portion 108 includes convex contours, concave contours, or both to provide surface contact area for particular drinking vessels.

An additional advantage of the system, viewable in FIGS. 2A through 2E, is an inner cavity 142. The inner cavity 142 allows for efficient and long-lasting temperature control, insulation, or a combination thereof. For example, the inner cavity 142 may carry and contain a liquid solution. When placed in the freezer, the liquid solution may freeze, thereby increasing the time and degree of drink temperature control and maintenance.

As shown by FIGS. 2A through 2E, between the inner wall portion 108 and outer wall portion 110, and between the top end portion 116 and bottom end portion 118, there may be defined an inner cavity 142. The top end portion 116, bottom end portion 118, inner wall portion 108, and outer wall portion 110, define a top boundary, bottom boundary, inner boundary, and outer boundary of the inner cavity 142, respectively. The boundaries enclose the inner cavity 142. The inner cavity 142 may contain and carry air or gasses. The inner cavity 142 may include an evacuated chamber. The evacuated chamber in the inner cavity 142 may have a pressure less than 600 Torr, less than $10^{-1}$ Torr, less than $10^{-2}$ Torr, less than $10^{-3}$ Torr, or less than $10^{-4}$ Torr. The inner cavity 142 may contain and carry solids, such as Styrofoam or plastic-coated wood. The inner cavity 142 may contain and carry a liquid solution such that the inner cavity 142 is partially or fully filled. The liquid solution may include water, gel such as alcohol gel, a solute, or a combination thereof. A liquid solution in the inner cavity 142 may have a freezing point, for example, above the temperature of household freezers. The inner cavity 142 may allow for longer temperature retention of the receptacle, thereby increasing the time the temperature of a drink is controlled. The inner cavity 142 may include an expansion area, allowing room for a solution to expand, such that a frozen solution does not exert sufficient pressure on the boundaries of the inner cavity 142 so as to damage the receptacle. Although an inner cavity 142 is shown in FIGS. 2A through 2E, the system may include a receptacle or receptacles without an inner cavity 142. Although only part of the system is shown in FIGS. 2A through 2E, the inner cavity may extend around the receptacle to encompass a drinking vessel or may be housed in a portion or portions of the receptacle.

Figure 3B:
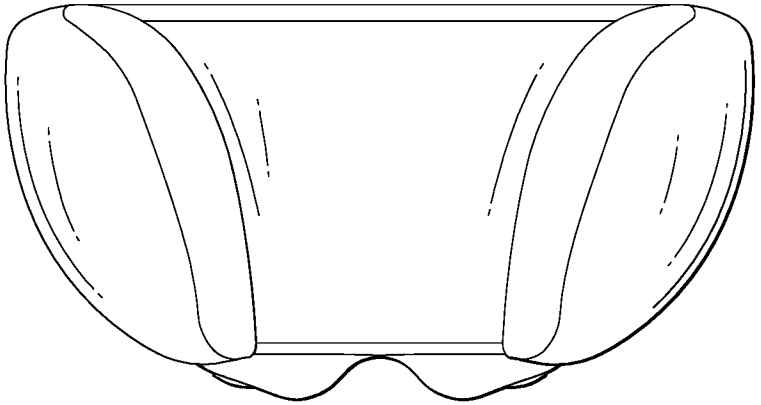
FIG. 3B is a schematic diagram of a receptacle with a second shape defining a recess with a second shape.
Figure 3D:
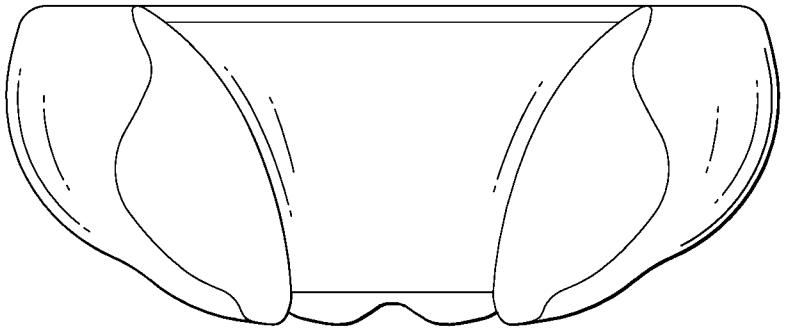
FIG. 3D is a schematic diagram of a receptacle with a fourth shape defining a recess with a fourth shape.
Figure 3A:
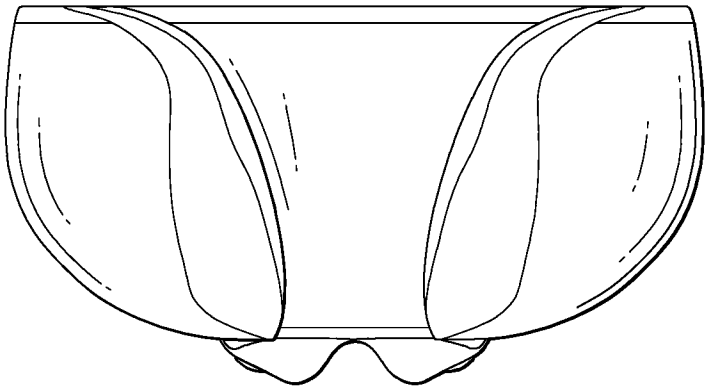
FIG. 3A is a schematic diagram of a receptacle with a first shape defining a recess with a first shape.
Figure 3C:
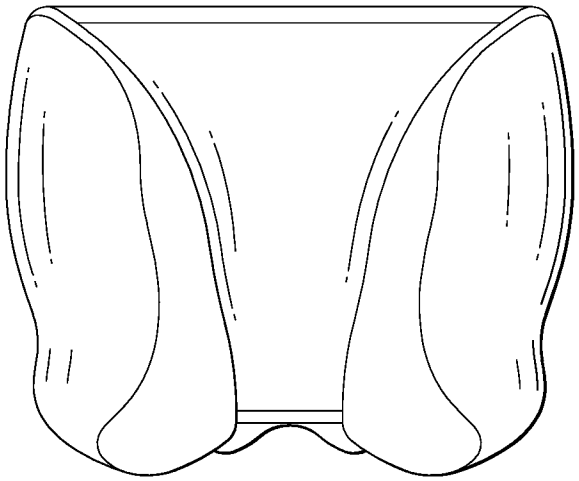
FIG. 3C is a schematic diagram of a receptacle with a third shape defining a recess with a third shape.
Figure 3E:
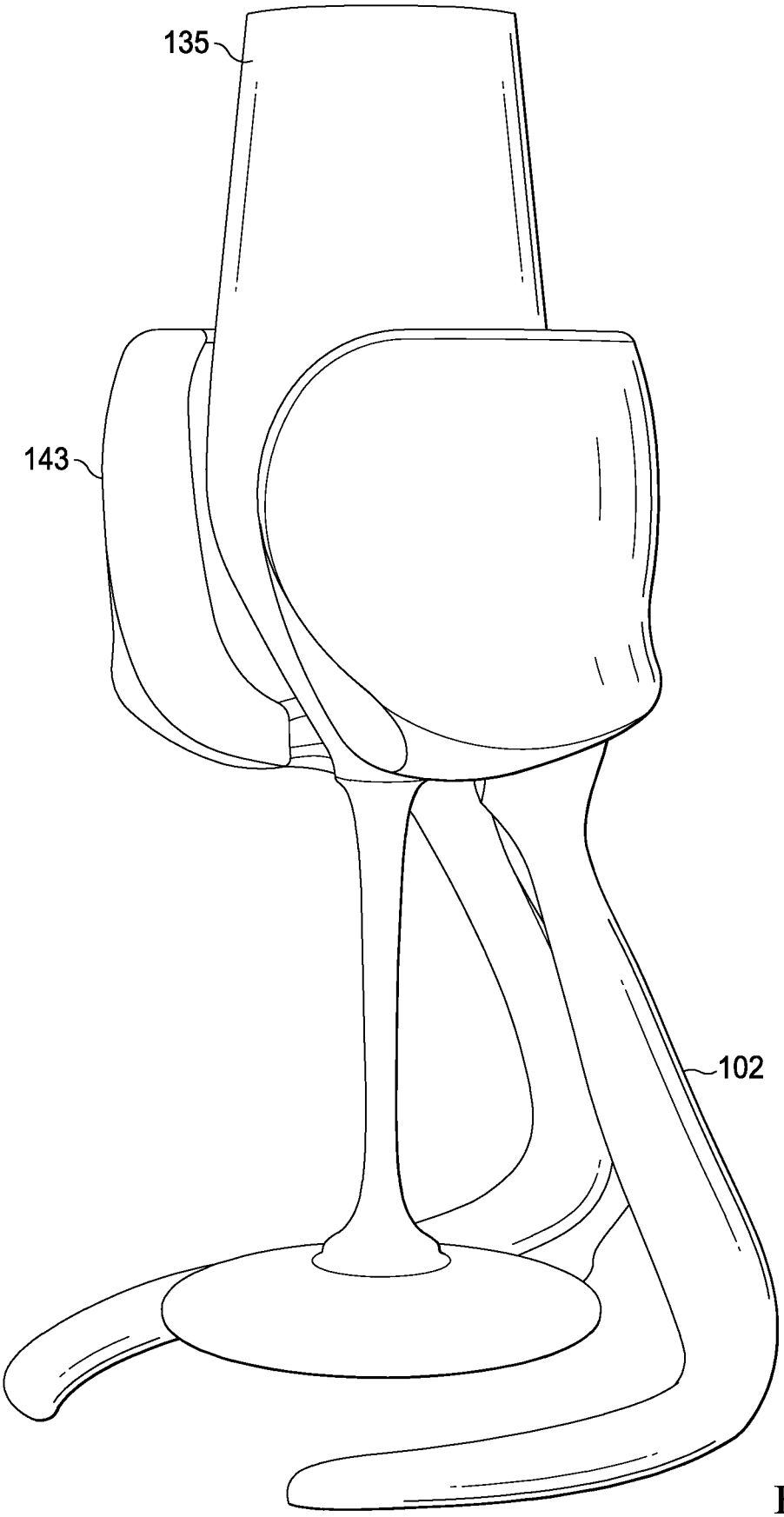
FIG. 3E is a schematic diagram of a system for controlling the temperature of a drink in use with a champagne flute.

One advantage of the system is that it may use multiple receptacles to hold different-shaped drinking vessels. FIGS. 3A through 3E depict multiple receptacles with different shapes defining recesses with different shapes. Each receptacle may releasably attach to the same stand via common attachment shapes. For example, each receptacle may attach to any one or more stands by mating parts such as a pin and hole, or complimenting shapes, magnets, a hinge, joint, or any other attachment mechanism. All receptacles and stands in a system may share common attachment shapes to allow for modularity and interchangeability. In addition to accommodating multiple different drinking vessels, multiple receptacles allow for one or more receptacles to be heated or cooled while another receptacle is in use. For example, a user may be using one receptacle in a system to chill a drinking vessel while another receptacle is sitting in the user's freezer. Each receptacle may be used with and releasably attached to a variety of stands, for example with each stand shown in other FIGURES in this disclosure. FIG. 3E shows a system with the stand 102 and a receptacle 143. The receptacle 143 is releasably attached to the stand 102 and is holding a champagne flute 135. Although FIGS. 3A through 3E show multiple receptacles with different shapes, the system may include multiple receptacles with the same shape, such as receptacles shown in other FIGURES. A system with multiple receptacles with the same shape is beneficial, for example, because a user can have a cooled receptacle for each additional glass of wine. Further, as mentioned earlier, a receptacle can receive many different types of drinking vessels.

Figure 4A:
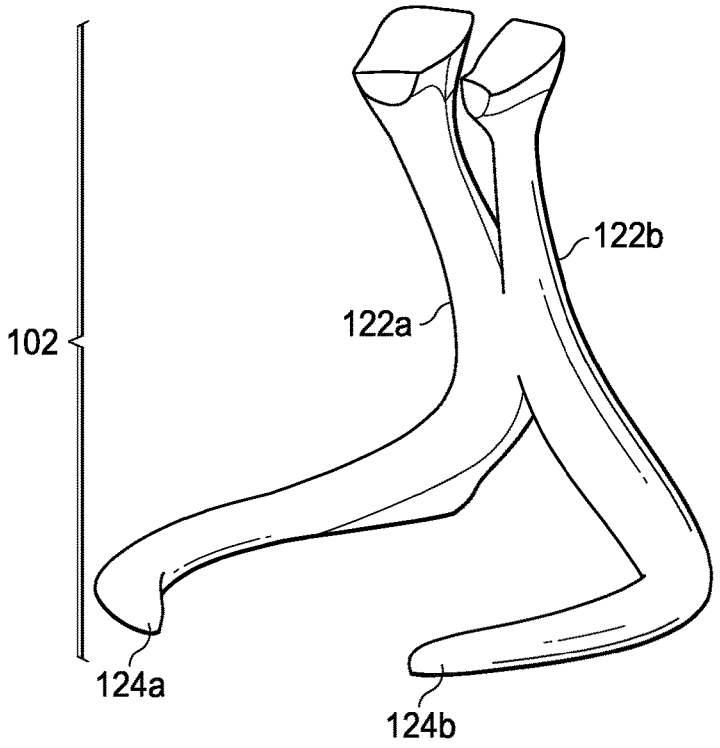
FIG. 4A is a schematic diagram of an elongated stand.
Figure 4B:
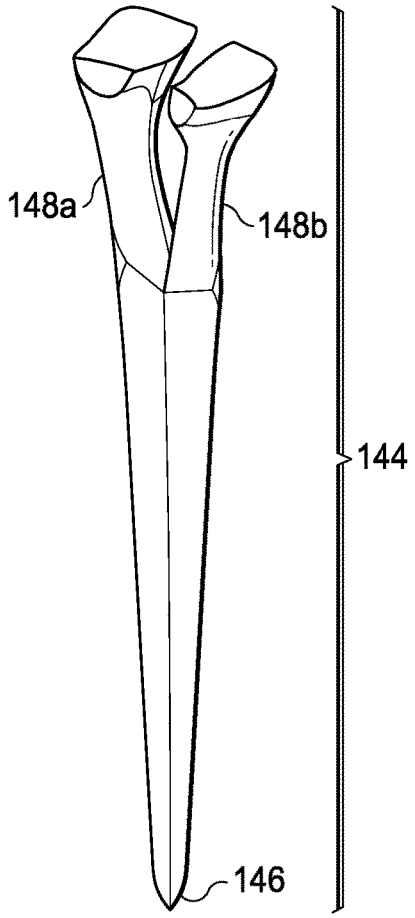
FIG. 4B is a schematic diagram of an elongated stand with a pointed end.
Figure 4C:
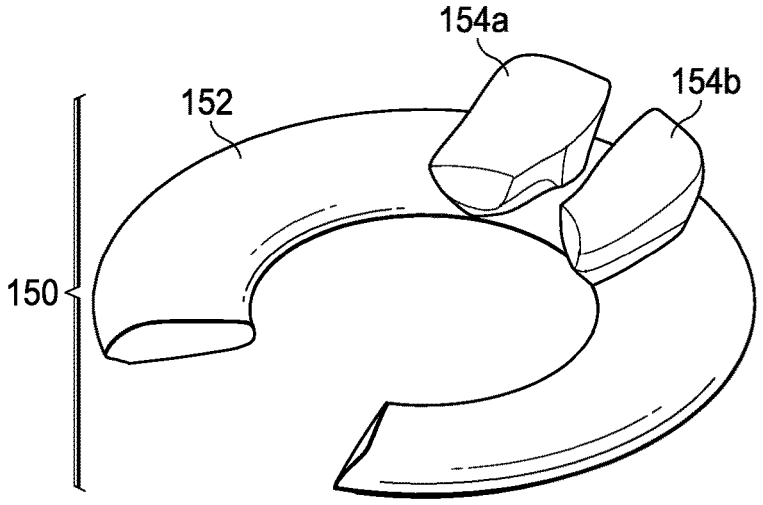
FIG. 4C is a schematic diagram of a stand that is substantially flat.

Another advantage of the system is that it may be used in different settings. For example, the system may have different stands for different uses, such as for use outdoors. FIGS. 4A, 4B, and 4C collectively depict multiple stands in which different receptacles with common attachment shapes may be used. For example, each depicted stand may be used with and releasably attached to receptacles shown in other FIGURES in this disclosure.

An elongated stand may be used to hold above a supporting surface and cool, for example, a stemmed wine glass. FIG. 4A depicts a stand 102, shown in FIGS. 1A through 1C, that may be used with a stemmed wine glass. The stand 102 as shown is elongated. The stand 102 is operable to hold a receptacle upright. The depicted embodiment has two stand prongs 122*a* and 122*b*, each with a foot 124*a* and 124*b*. The feet 124*a* and 124*b* may contact the surface, such as a tabletop or the ground, thereby holding the stand 102 upright.

For use outdoors or for use with a soft, penetrable supporting surface such as earth, a stand may be configured to be inserted into the supporting surface. For example, FIG. 4B depicts a stand 144. The stand 144 as shown is elongated and has a pointed end 146. The pointed end 146 may be inserted securely into a soft supporting surface such as dirt, sand, or grass. The stand 144 may have two stand prongs 148*a* and 148*b*. When attached to a receptacle, the stand 144 can thereby hold a receptacle upright above a soft surface. For example, a user may wish to cool a drink while sitting on the ground outdoors.

For use with a drinking vessel without a stem, such as a stemless wine glass, mug, or a whiskey glass, a stand may be configured so as to use minimal space. For example, FIG. 4C depicts a stand 150. The stand 150 as shown is substantially flat. The stand 150 is shown with one foot 152. The stand 150 may hold a receptacle upright. The stand may have two stand prongs 154*a* and 154*b*. Although a receptacle may be configured to be substantially flat at a bottom end portion to hold, for example, a stemless wine glass, coffee cup, or snifter, upright without a stand, the stand 150 may be attached to a receptacle to hold a stemless wine glass (or a variety of other drinking vessels). The foot 152 may contact the surface, such as a tabletop or the ground, thereby holding the stand 150 upright.

Different stands, as depicted by example in FIGS. 4A through 4C allow for a system with greater versatility than other systems. The different stands allow for a system that can be used with different drinking vessels and in different environments. A user may wish to use a drinking vessel with a stem, such as a wine glass or a drinking vessel without a stem, such as a whiskey glass. The user may wish to use a drinking vessel while sitting at a table or while sitting on the ground at a picnic.

Figure 5:
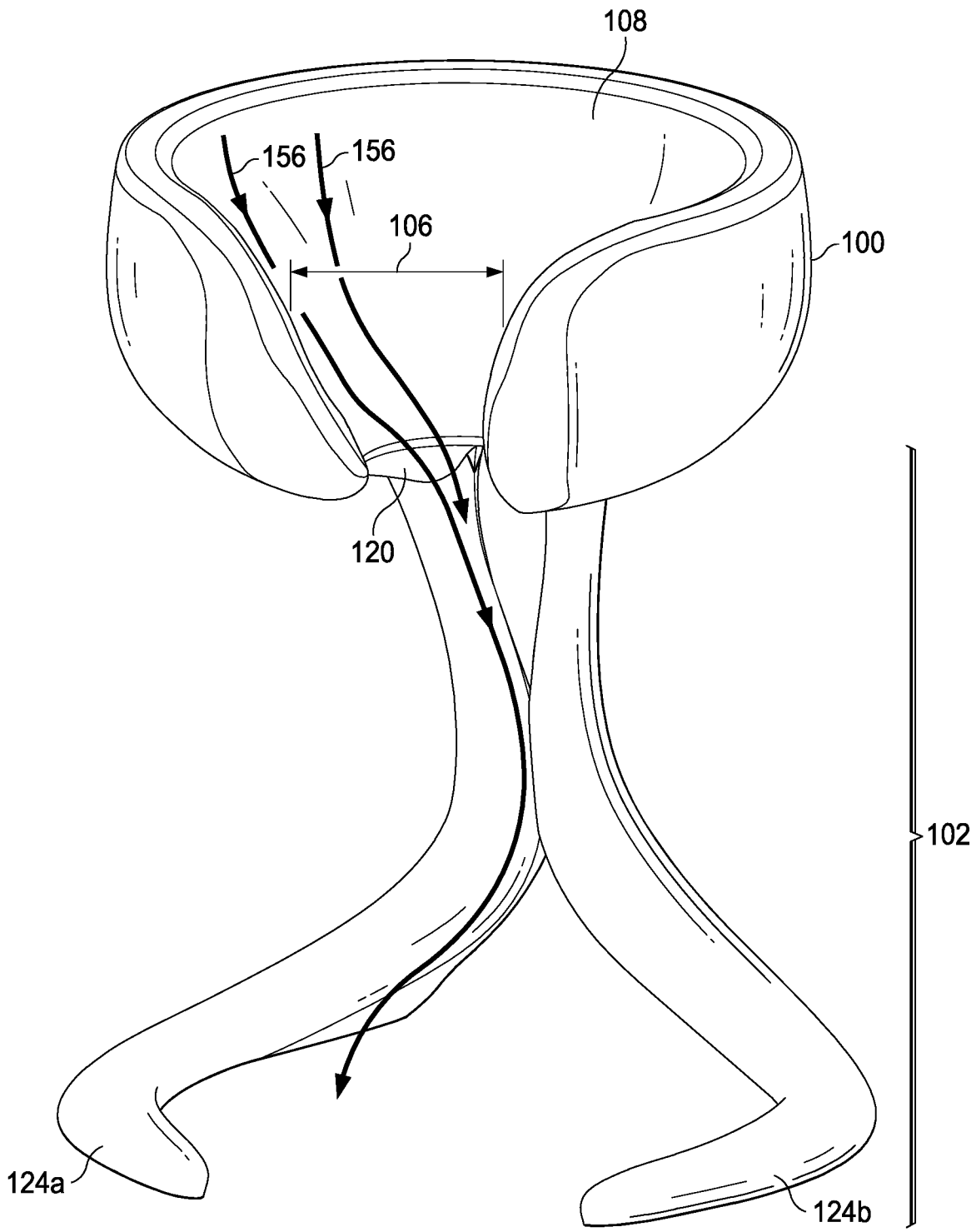
FIG. 5 is a schematic diagram of the system of FIG. 1A, with a highlighted condensation path.

As described above, the system may include a lip to route condensation away from undesired locations. The system may also include a condensation path to route condensation. For example, FIG. 5 depicts the system of FIGS. 1A through 1C with a highlighted condensation path 156. As shown by example in FIG. 5, the condensation path 156 may be formed in part or wholly by contours of the receptacle 100 and stand 102. For example, the inner wall portion 108 is sloped downwardly towards lip 120.

The condensation path 156 allows for moisture that accumulates on the drinking vessel or system to flow to a desired location, such as a foot 124*a* or 124*b*, or a location on the receptacle 100. The location on the receptacle 100 for the moisture to flow is away from where the user will grab the drinking vessel at the side opening 106, and away from where the condensation will drip onto a foot of a wine glass, for example. As highlighted in FIG. 5, condensation path 156 extends from the receptacle 100 to the stand 102. The condensation path 156 includes the lip 120. The lip 120 may be shaped to protrude downwardly, as shown in FIG. 5, such that condensation drips off the lip 120, away from the user's hand. In FIG. 5, the condensation path 156 includes the lip 120 and ends at the feet 124*a* and 124*b*.

The condensation path 156 may be formed differently. For example, the system may include a condensation path that is formed in part or wholly by a groove on the surface of the inner wall portion 108, stand 102, or both. The condensation path 156 is yet another advantage the system may have, as it prevents unwanted moisture from traveling to undesired locations.

Figure 6:
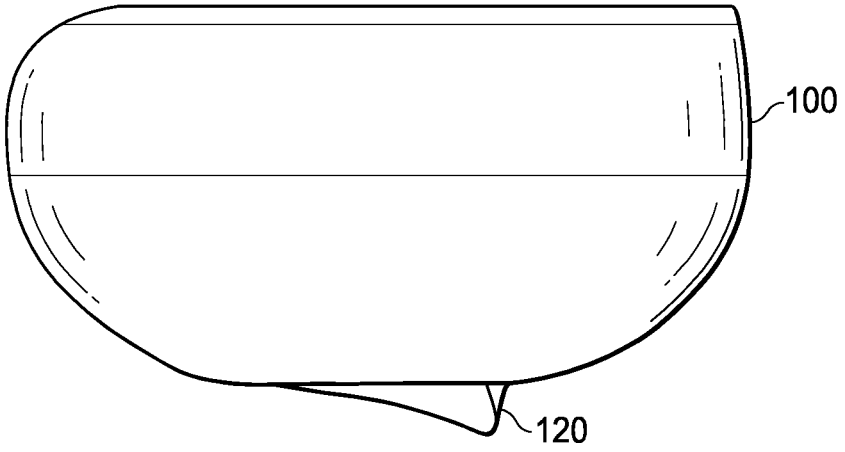
FIG. 6 is a schematic side view of the receptacle of FIG. 1A, with the lip viewable.

As described above, lip 120 offers advantages such as reducing or eliminating moisture contact with a user's hand. To view lip 120, FIG. 6 depicts a side view of receptacle 100 of FIG. 5.

Figure 7A:
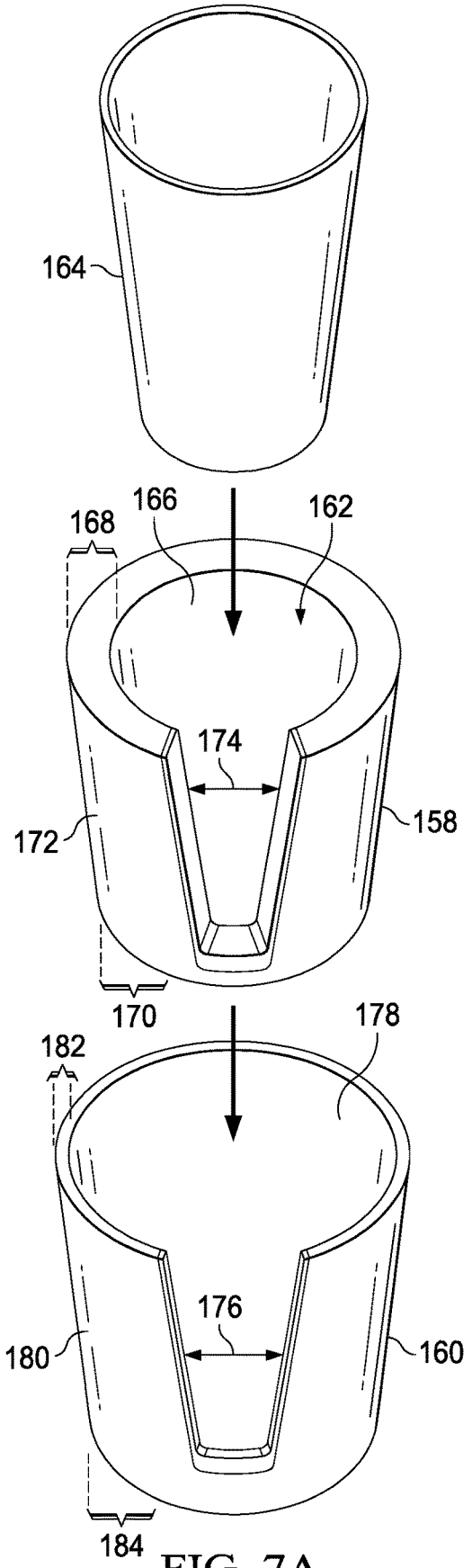
FIG. 7A is a schematic diagram of a system for controlling the temperature of a drink, with a receptacle detached from a stand.

Another advantage of the system is that it may also be used to efficiently control the temperature of a drink within a drinking vessel such as a pint glass. An additional advantage may allow the pint glass and drink to be viewable while the system controls and maintains the drink temperature. An additional advantage of the system is that the user may fine-tune the temperature to their liking. For example, the user may simply lift their drinking vessel from the receptacle and hold or set the drinking vessel directly on a supporting surface to allow the drink to warm slightly. A stand may also have added functionality to increase insulation and improve the time the drink is maintained at a desired temperature. For example, a stand may have an evacuated chamber to improve insulation. A stand may also be securely and releasably attachable to the receptacle by complimenting the shape of the receptacle, thereby shrouding the receptacle. FIG. 7A depicts an example of the system for controlling the temperature of a drink with a receptacle 158 and a stand 160. The receptacle 158 is shown detached from the stand 160. The receptacle 158 is shaped to define a recess 162 to receive a drinking vessel 164 such as a pint glass. The inner wall portion 166 is sloped inwardly from the top end portion 168 to the bottom end portion 170. The outer wall portion 172 is sloped inwardly from the top end portion 168 to the bottom end portion 170. Since the receptacle 158 compliments the shape of the drinking vessel 164, the receptacle 158 allows for a large surface area of the receptacle 158 to contact the drinking vessel, thereby enabling efficient transfer of thermal energy.

The receptacle 158 shown defines a side opening 174 to allow parts of a drinking vessel 164 to be viewed while the system holds the drinking vessel 164. Alternatively, a receptacle may fully shroud the pint glass. The side opening 174 also allows the drinking vessel 164 to be easily received by the recess 162 by providing the user more space to grab the drinking vessel 164. As depicted in FIG. 7A, the side opening 174 extends laterally from the inner wall portion 166 to the outer wall portion 172. As described above in this disclosure, between the inner wall portion 166 and outer wall portion 172, and between the top end portion 168 and bottom end portion 170, there may be defined an inner cavity.

The stand 160 also defines a stand side opening 176 such that the drinking vessel 164 is viewable when held by the receptacle 158 when the receptacle 158 is releasably attached to the stand 160. The stand 160 includes an evacuated chamber. The evacuated chamber may be contained between a stand inner wall portion 178, a stand outer wall portion 180, a top stand portion 182, and a bottom stand portion 184. The evacuated chamber has a pressure less than 600 Torr, less than $10^{-1}$ Torr, less than $10^{-2}$ Torr, less than $10^{-3}$ Torr, or less than $10^{-4}$ Torr. The evacuated chamber provides for better insulation of the drinking vessel 164 when the receptacle 158 is holding the drinking vessel 164 and is releasably attached to the stand 160. The stand 160 and receptacle 158 also may include an outer texture sleeve to allow for better grip when, for example, the user removes the receptacle 158 from a freezer. The outer texture sleeve may be releasably attachable.

Figure 7B:
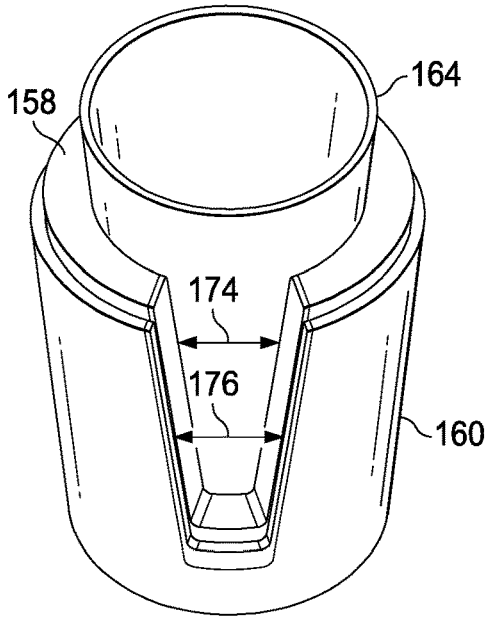
FIG. 7B is a schematic diagram of the system of FIG. 7A with the receptacle releasably attached to the stand.

The system as configured for a pint glass or other glasses may include the releasably attachable functionality and modularity. As mentioned above, releasably attachable parts may save space, for example in a freezer, and may add versatility to the system. FIG. 7B depicts the system for controlling the temperature of a drink in FIG. 7A, with the receptacle 158 releasably attached to the stand 160. In the depicted example, the receptacle 158 and stand 160 releasably attach by being complimentarily shaped, such that the receptacle 158 fits tightly within the stand 160. As shown by FIG. 7B, the stand 160 shrouds the receptacle 158 and may thereby improve insulation and increase the time of temperature control. Also as shown by FIG. 7B, the drinking vessel 164 viewable due to the side opening 174 and stand side opening 176.

FIGS. 7A and 7B use a pint glass as an example. The receptacle 158 and stand 160 depicted in FIGS. 7A and 7B may be complimentarily shaped to releasably attach and fit any drinking vessel. To provide longer temperature control and maintenance, the system may have a receptacle without a side opening and a stand without a stand side opening.

Figure 8A:
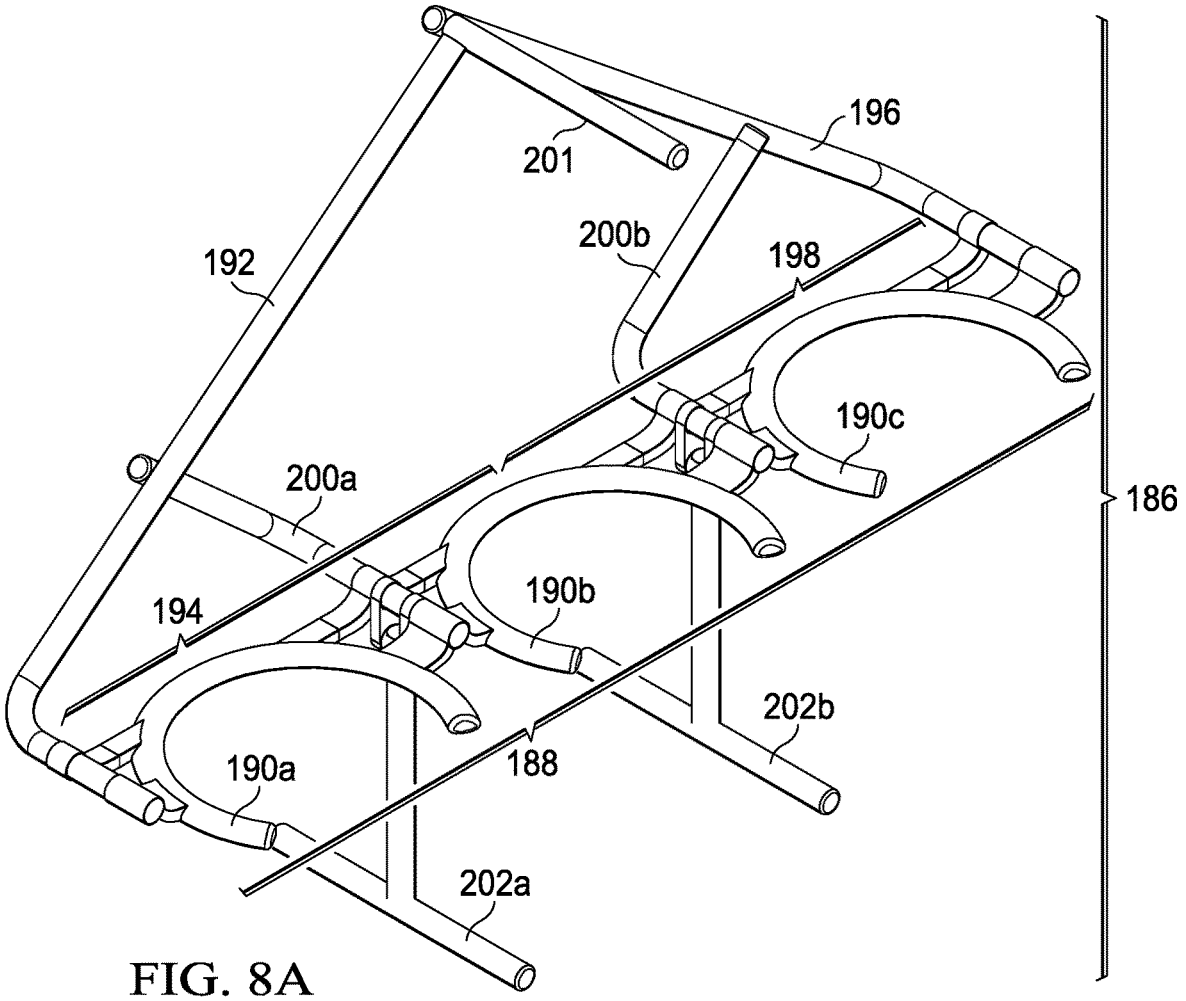
FIG. 8A is a schematic diagram of a rack.

The system offers further advantages over previous systems in that it may include a rack to allow for easy carrying. Other systems may be bulky and therefore difficult to carry and store. FIG. 8A depicts a portion of an exemplary system, a rack 186. The rack 186 has a tray 188 that is used to carry one or more receptacles releasably attached to stands, one or more drinking vessels, or a combination thereof. The tray 188 has a hand 190*a*, a hand 190*b*, and a hand 190*c*, each for receiving a receptacle releasably attached to a stand, a drinking vessel, or a combination thereof. Each hand 190*a*, 190*b*, and 190*c* is substantially C-shaped, as shown in FIG. 8A. Alternatively, hands may be shaped as two straight lines, for example. The hands 190*a*, 190*b*, and 190*c* fit under a receptacle, drinking vessel, or both to lift the receptacle, drinking vessel, or both when a user exerts an upward force on the hands 190*a*, 190*b*, and 190*c*. The rack 186 may include any number of hands to carry any number of one or more receptacles releasably attached to stands, one or more drinking vessels, or a combination thereof.

The rack 186 has a first arm 192 attached to a first tray side 194. The first arm 192 may be attached to the first tray side 194 by a hinge, joint, mating parts such as a pin and hole, or complimenting shapes, magnets, or any other attachment mechanism. The rack 186 has a second arm 196 attached to the second tray side 198. The second arm 196 may be attached to the second tray side 198 by a hinge, joint, mating parts such as a pin and hole, or complimenting shapes, magnets, or any other attachment mechanism. The first arm 192 and the second arm 196 are attached such that the first arm 192 and the second arm 196 may fold, as described later. The first arm 192 and the second arm 196 have movable secondary arms 200*a* and 200*b* further attaching the first arm 192 and second arm 196, respectively, to the tray 188. The rack 186 may also have two rack feet 202*a* and 202*b* to stand the rack 186 upright on a supporting surface.

The rack feet 202*a* and 202*b* are attached to the tray 188 and are foldable under the tray 188. The rack feet 202*a* and 202*b* may be attached to the tray 188 by a hinge, joint, mating parts such as a pin and hole, or complimenting shapes, magnets, or any other attachment mechanism. The rack 186 includes a rack handle 201 to allow the user to more easily carry the rack 186.

Figure 8B:
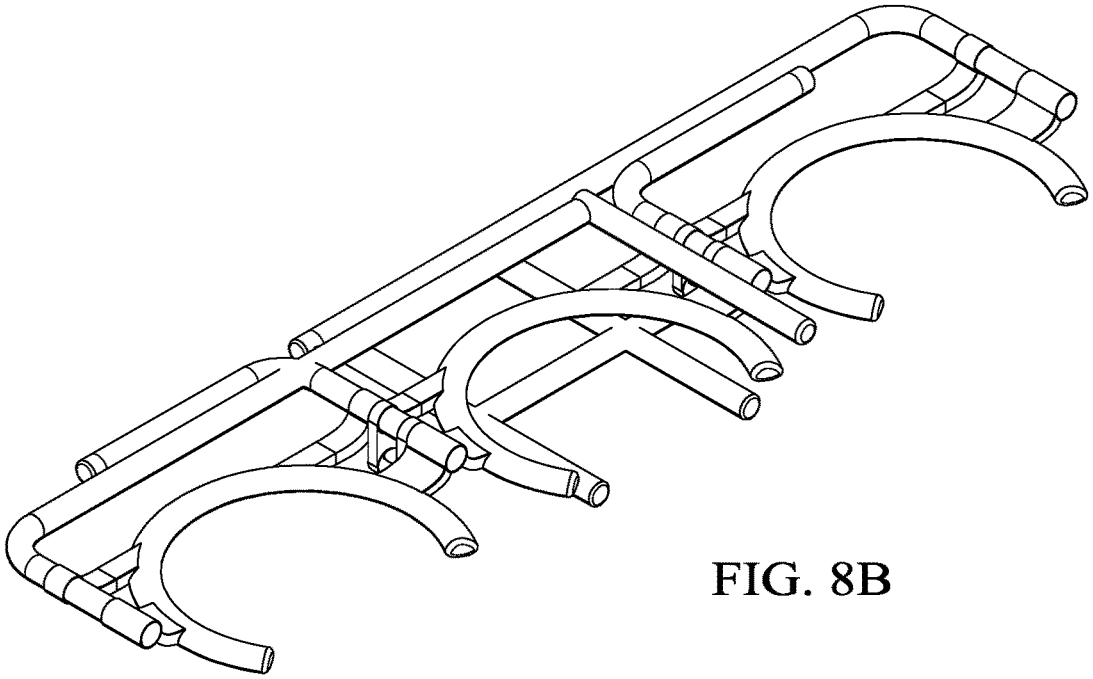
FIG. 8B is a schematic diagram of the rack of FIG. 8A in a folded position.
Figure 8C:
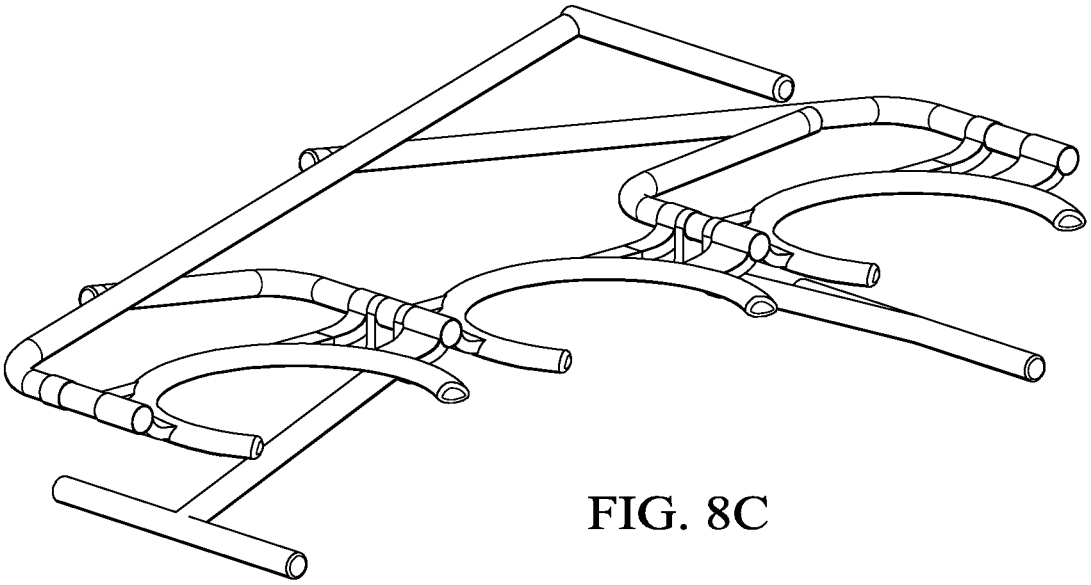
FIG. 8C is a schematic diagram of the rack of FIG. 8A in a partially folded position.

Storage spaces can be limited in settings where one or more drinking vessels, receptacles, stands, or a combination thereof are used. For example, a restaurant or bar may need numerous receptacles and drinking vessels and may need a rack to carry the receptacles to tables. But the restaurant may have limited storage space. Therefore, a rack that can carry the system but can be stored in a small amount of space is desired. The rack 186 can further save space for the user by being foldable when not being used for carrying. For example, FIG. 8B depicts the rack 186 of FIG. 8A in a folded position. FIG. 8C depicts the rack 186 of FIG. 8A in a partially folded position.

Figure 9:
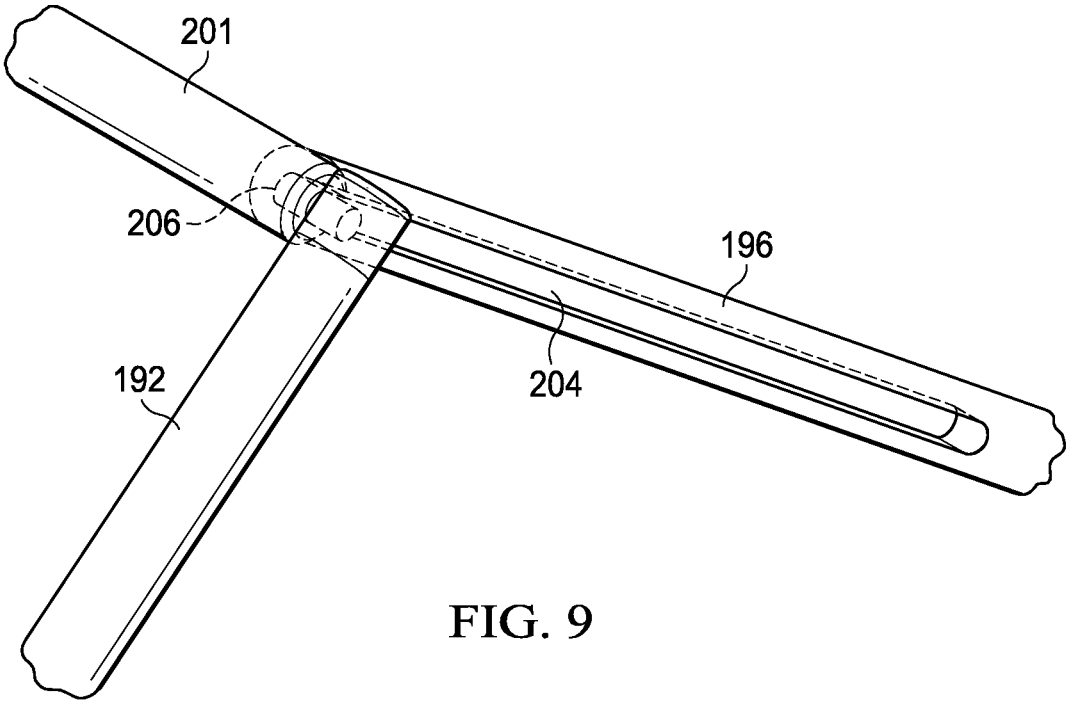
FIG. 9 is a schematic partial rear view of the rack of FIG. 8A.

In one example of how the rack 186 in FIGS. 8A through 8C can fold to save space, FIG. 9 depicts how the first arm 192 and second arm 196 may fold. FIG. 9 shows a partial rear view of the rack depicted in FIGS. 8A through 8C. The second arm 196 may have a track 204 that allows a wheel 206 of the first arm 192 to slide in the track 204, thereby folding the rack. The wheel 206 need not rotate to slide in the track 204. Wheel 206 is a cylindrical pin. A wheel may revolve around an axle, may have a low-friction surface, or both.

Figure 10:
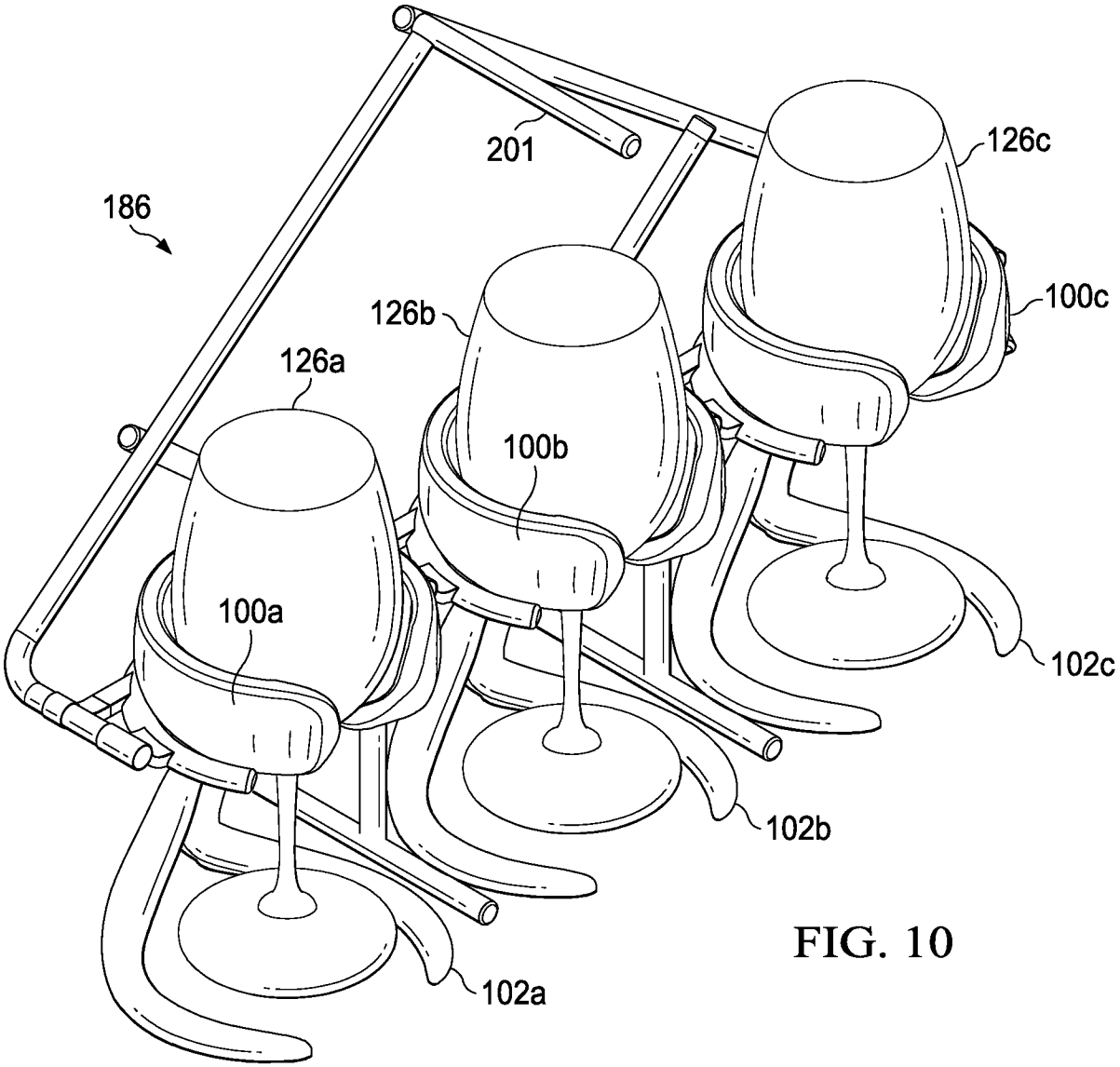
FIG. 10 is a schematic diagram of a system with the rack of FIG. 8A carrying three receptacles, stands, and drinking vessels.

FIG. 10 depicts a system with the rack 186 of FIG. 8C. The system is shown with rack 186 carrying three receptacles 100*a*, 100*b*, and 100*c* releasably attached to three stands 102*a*, 102*b*, and 102*c*. Each receptacle 100*a*, 100*b*, and 100*c* is shown holding a drinking vessel 126*a*, 126*b*, or 126*c*. The system is modular, as any of the three receptacles 100*a*, 100*b*, and 100*c* may be releasably attached to any of the three stands 102*a*, 102*b*, or 102*c*. When a user lifts the rack, for example by the rack handle 201, the user may lift and carry the system.

Figure 11A:
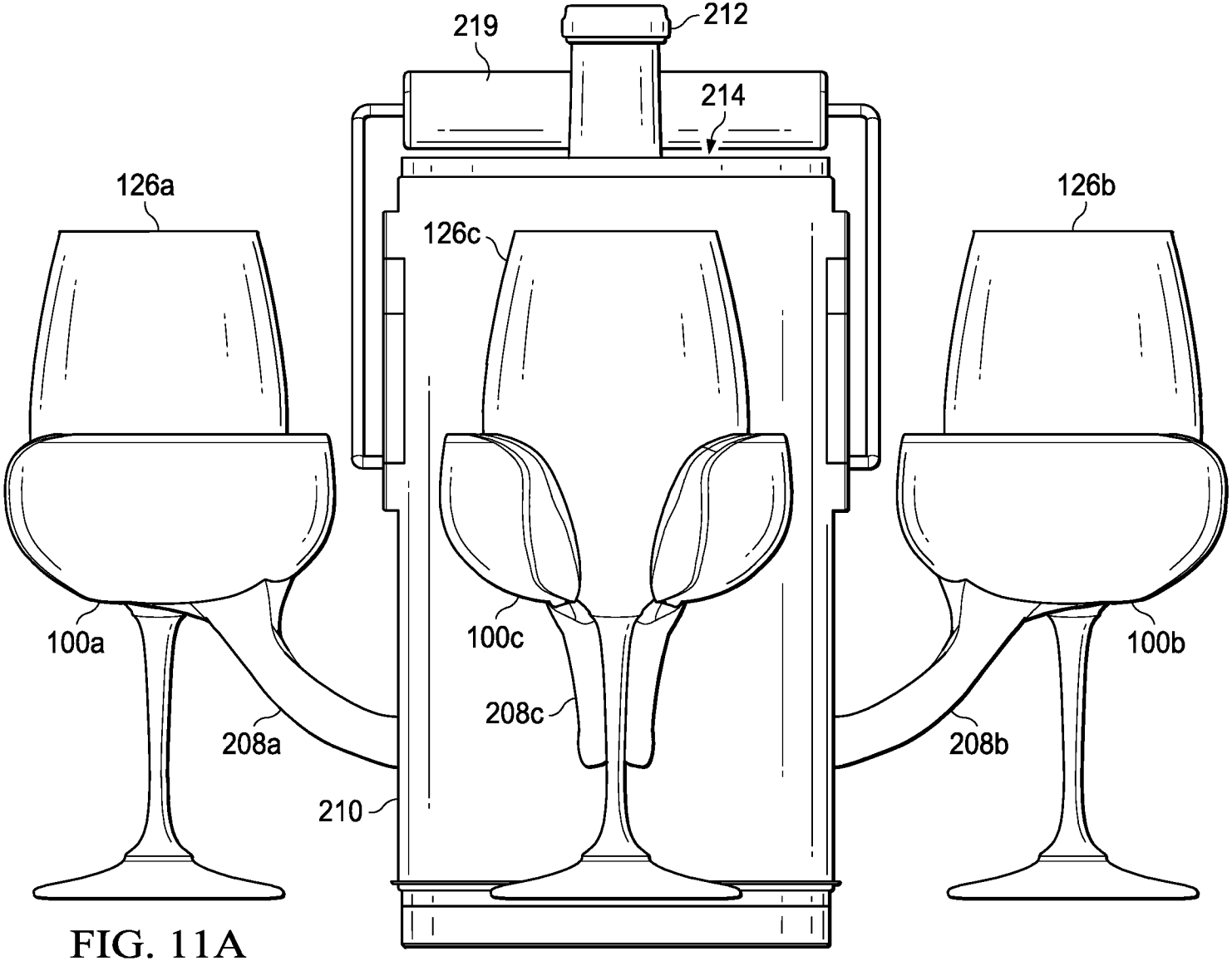
FIG. 11A is a schematic diagram of a system for controlling the temperature of a drink with a canister.

In an exemplary system, the system includes a canister to hold a wine bottle and multiple stands for attaching receptacles. Users may wish to maintain the temperature of a bottle while viewing it or sharing it at a restaurant. The canister may be configured to receive any type of bottle or drinking vessel. The system can simultaneously control and maintain the temperature of wine within a wine bottle and wine poured into wine glasses. Users may also wish to easily carry one or more receptacles, stands, drinking vessels, bottles, or a combination thereof. FIG. 11A depicts an exemplary system that allows for easy carrying and simultaneous temperature control of drinking vessels and a bottle. Each receptacle 100*a*, 100*b*, and 100*c* is shown releasably attached to stands 208*a*, 208*b*, and 208*c*, respectively. The stands 208*a*, 208*b*, and 208*c* are mounted on a canister 210. The canister 210 has a fourth stand mounted on a rear side of the canister, not viewable in FIG. 11A. The stands 208*a*, 208*b*, and 208*c* may alternatively be releasably attached to the canister 210. The canister 210 is operable to receive a wine bottle 212 with a canister recess 214 defined by the canister 210.

To maintain and control the temperature of the wine bottle 212, the canister 210 may be thermally insulated so as to prevent thermal energy from traveling into the canister recess 214. For example, the canister 210 may include a canister inner cavity. The canister inner cavity may include an evacuated chamber. The evacuated chamber in the canister inner cavity may have a pressure less than 600 Torr, less than $10^{-1}$ Torr, less than $10^{-2}$ Torr, less than $10^{-3}$ Torr, or less than $10^{-4}$ Torr. To maintain and control the temperature of the wine bottle 212, for example, the canister inner cavity may be filled with thermal material including a solid, gas, liquid, or combination thereof. The canister inner cavity or canister recess 214 may be filled with ice to control and maintain the temperature of the wine. The user may place the canister 210 in a cooling or heating environment before use.

The canister 210 may include a removable inner sleeve. The removable inner sleeve may function so that the user can store only the removable inner sleeve in a heating or cooling environment so as to save space in the heating or cooling environment. The removable inner sleeve may be part of or include any part of the canister 210. For example, the inner sleeve may include the inner cavity and evacuated chamber.

One advantage of the system of FIG. 11A is that it allows a user to simultaneously control the temperature of wine within a wine bottle and wine within drinking vessels held by the receptacles 100*a*, 100*b*, and 100*c*. Since the receptacles 100*a*, 100*b*, and 100*c* are releasably attachable to the stands 208*a*, 208*b*, and 208*c* mounted on the canister 210, receptacles that have been warmed over time may be swapped for cool receptacles. The system therefore allows the temperature of drink to be controlled and maintained for extended periods of time. Additionally, the system may be used with receptacles with different shapes to accommodate different drinking vessels. The system can therefore be used when, for example, users wish to enjoy wine of a first type using a first type of glass, then switch to a second type of wine using a second type of glass. A system with a canister may be configured to use any number of receptacles and stands. The system may be used with stands with different lengths or extendable stands for differently sized tables. The system may have more or less stands and receptacles. A canister may be shaped to receive multiple bottles.

Figure 11B:
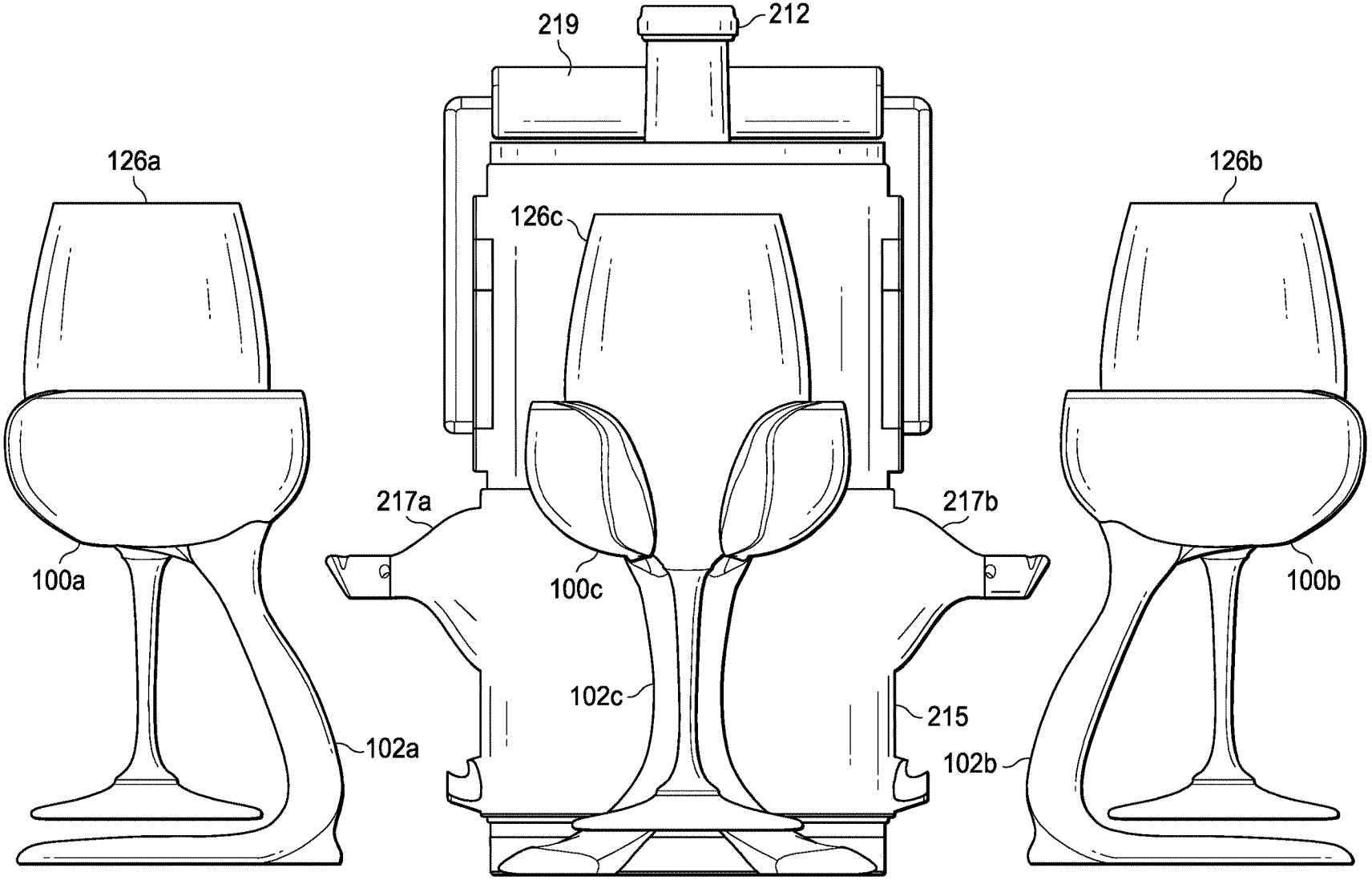
FIG. 11B is a schematic diagram of a system for controlling the temperature of a drink with a canister with canister arms.

Users may wish to enjoy the benefits of a canister, such as easy carrying and simultaneous temperature-control of a bottle, while also enjoying the mobility of a freestanding receptacle and stand. Each pair of freestanding receptacles and stands may be independently moved by each user, while still holding a drinking vessel, thereby temperature-controlling a drinking vessel and allowing each user to place their drinking vessel at a reachable location. Such mobility may be desired at a large table, where it may be difficult for all users to reach one location. FIG. 11B is an exemplary system with a canister 215 having freestanding receptacles 100*a*, 100*b*, and 100*c*, stands 102*a*, 102*b*, and 102*c* and drinking vessels 126*a*, 126*b*, and 126*c*. The receptacles 100*a*, 100*b*, and 100*c* are releasably attached to the stands 102*a*, 102*b*, and 102*c*, respectively. To securely hold receptacles and stands, canister arms 217*a* and 217*b* are mounted on the canister 215. Additional canister arms are mounted on the front and rear of the canister 215 but are not viewable at the angle shown in FIG. 11B. The canister arms 217*a* and 217*b* fit under receptacles 100*a* and 100*b* and the stands 102*a* and 102*b*. The canister arms 217*a* and 217*b* may be shaped to fit securely around the stand and receptacle to hold the receptacle and stand, while not intruding on the recess or preventing the receptacles 100*a* and 100*b* from holding the drinking vessels 126*a* and 126*b*. A canister handle 219 is attached to the canister 210. While the canister arms 217*a* and 217*b* securely hold the receptacles 100*a* and 100*b*, a user may lift the canister, or canister handle 219, thereby lifting the receptacles 100*a* and 100*b*, the stands 102*a* and 102*b*, releasably attached to the receptacles, and the drinking vessels 126*a* and 126*b* held by the receptacles 100*a* and

Figure 11C:
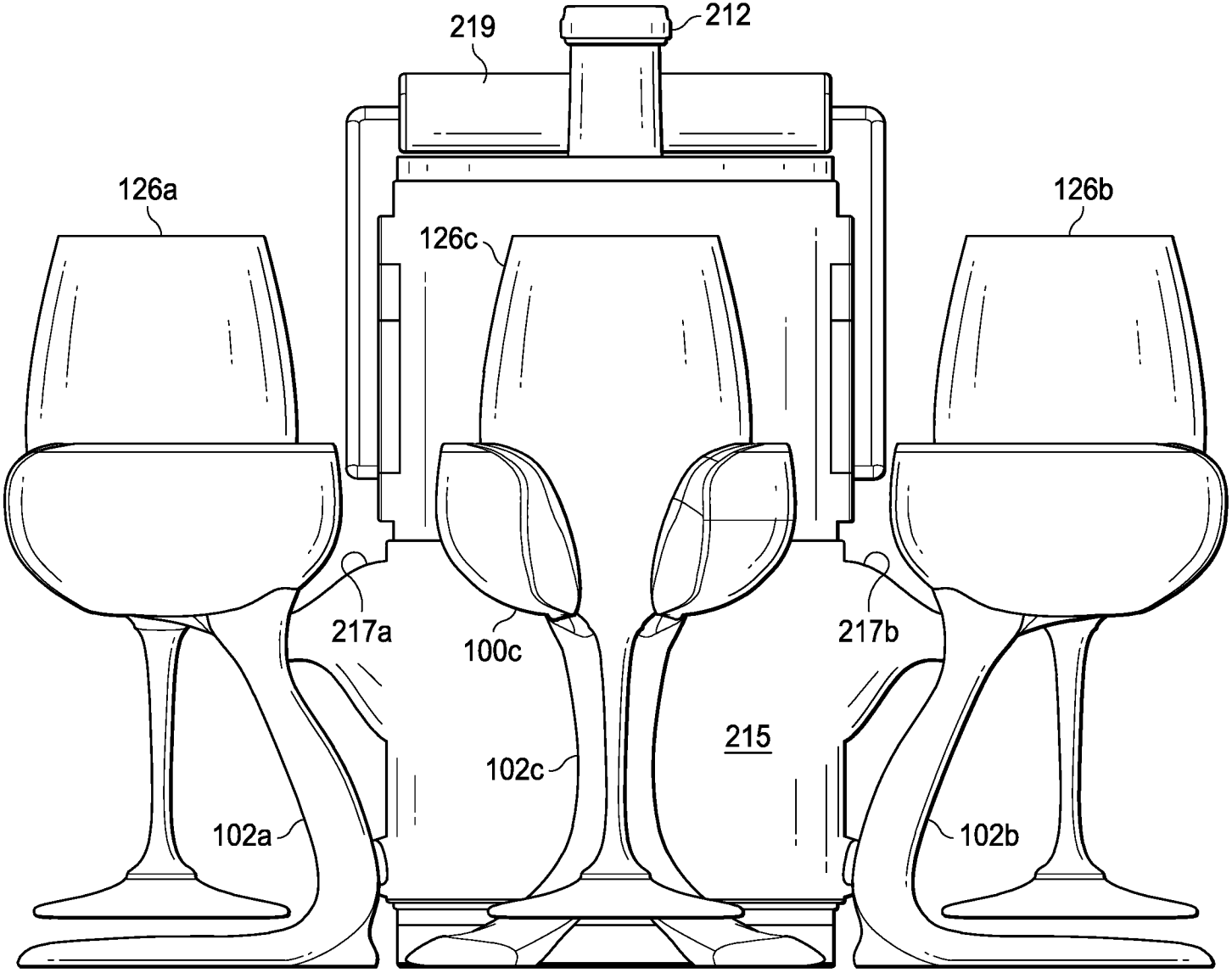
FIG. 11C is a schematic diagram of the system of FIG. 11B, with the canister arms shows holding receptacles.

100*b*. The system therefore allows a user to carry multiple receptacles, stands, drinking vessels, and a bottle. The system may include canister arms that releasably attach to stands or receptacles to securely hold the stands and receptacles. Canister arms may attach to stands by mating parts such as a pin and hole, magnets, a hinge, joint, or any other attachment mechanism. FIG. 11B shows the system while the canister arms 217*a* and 217*b* are not holding the stands 102*a* and 102*b* and receptacles 100*a* and 100*b*. FIG. 11C shows the system of FIG. 11B, while the canister arms 217*a* and 217*b* are holding the stands 102*a* and 102*b* and receptacles 100*a* and 100*b*. Stand 102*c* and receptacle 100*c* are being held by a canister arm that is not viewable. By lifting the canister handle 219, the user may carry the system and drinking vessels 126*a*, 126*b*, and 126*c* held by the system.

Drinks are often enjoyed out of stemless drinking vessels such as whiskey glasses or stemless wine glasses. Like drinks poured into stemmed drinking vessels, drinks poured into stemless drinking vessels are often poured such that the entire drinking vessel is not fully filled. For example, wine and whiskey are commonly poured to fill less than the entire drinking vessel or less than two-thirds, less than half, or less than a third of the drinking vessel. Filling less than the entire drinking vessel allows a user to swirl the drink in the glass, so that the user may better smell the complex aromas of the drink. Additionally, filling the drinking vessel with less drinking fluid exposes the drink to more oxygen and may thereby develop the flavor of the drink. In an exemplary system, the system may be used to hold stemless drinking vessels and contact a bottom portion of the drinking vessel to allow for efficient temperature control and maintenance, while still enabling viewing of the drinking vessel, the drink within, or both. The system may include a receptacle that shrouds a bottom portion of the drinking vessel where some, most, or all of the drink is likely to be contained. The system may also shroud most or all of the drinking vessel. FIG. 12A depicts an exemplary system, with the receptacle 216 defining a recess 218 and holding drinking vessel 220. Drinking vessel 220 is a stemless wine glass. The receptacle 216 is shown shrouding and contacting a bottom portion of the drinking vessel 220 where the drink is most likely to be contained. The system still allows the drinking vessel 220 to be viewed, or additionally allows a portion or all of the drink contained within to be viewed, thereby enhancing the user's enjoyment of the drink. The greater area of contact with the bottom portion of the drinking vessel 220 where the drink is contained allows for better thermal conduction and thereby better temperature control and maintenance. The receptacle 216 has a top end portion 222, a bottom end portion 224, an inner wall portion 226, and an outer wall portion 228. The top end portion 222 is shown defining a top opening 230 of the recess 218. The receptacle 216 is shown standing upright without a stand. The receptacle 216 includes a bottom opening 221. The bottom opening 221 allows condensation to drip through the opening instead of pooling in the bottom of the receptacle 216.

The receptacle 216 may hold many differently shaped drinking vessels. The system may include any other feature. For example, the system may include an inner cavity, a multivessel contour, both, or additionally or alternatively any one or more of other features as described elsewhere in this disclosure. A receptacle, while shown without a side opening in FIG. 12A, may include a side opening. The receptacle 216 may also releasably attach to a stand.

Figure 12B:
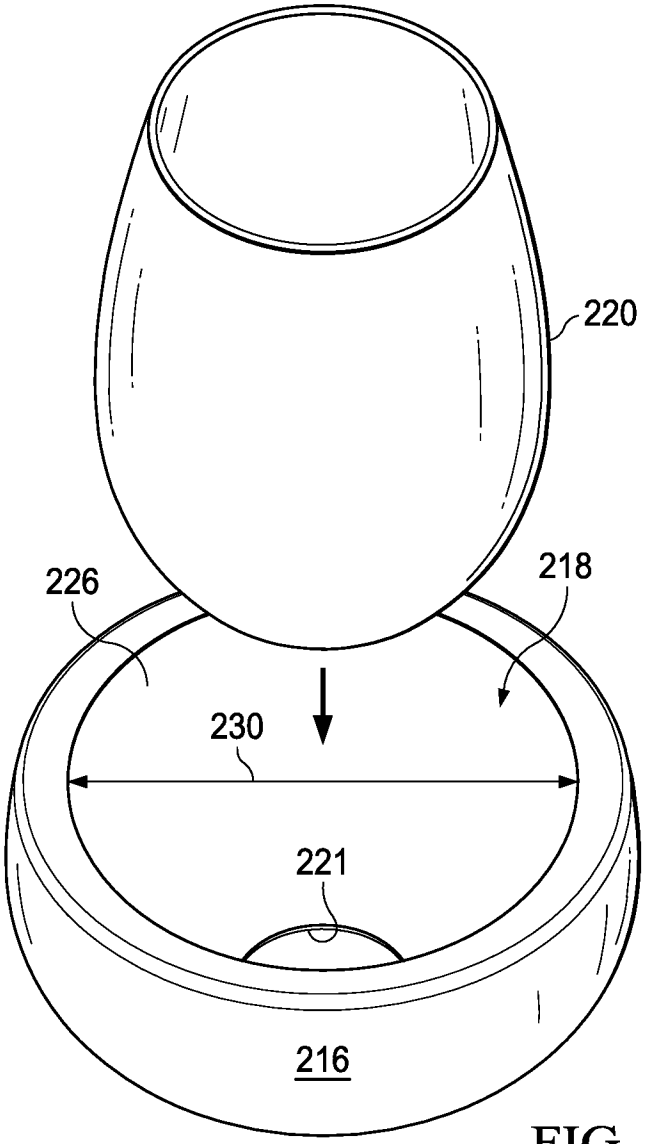
FIG. 12B is a schematic diagram of the system and drinking vessel of FIG. 12A, with the drinking vessel removed from the receptacle.
Figure 12A:
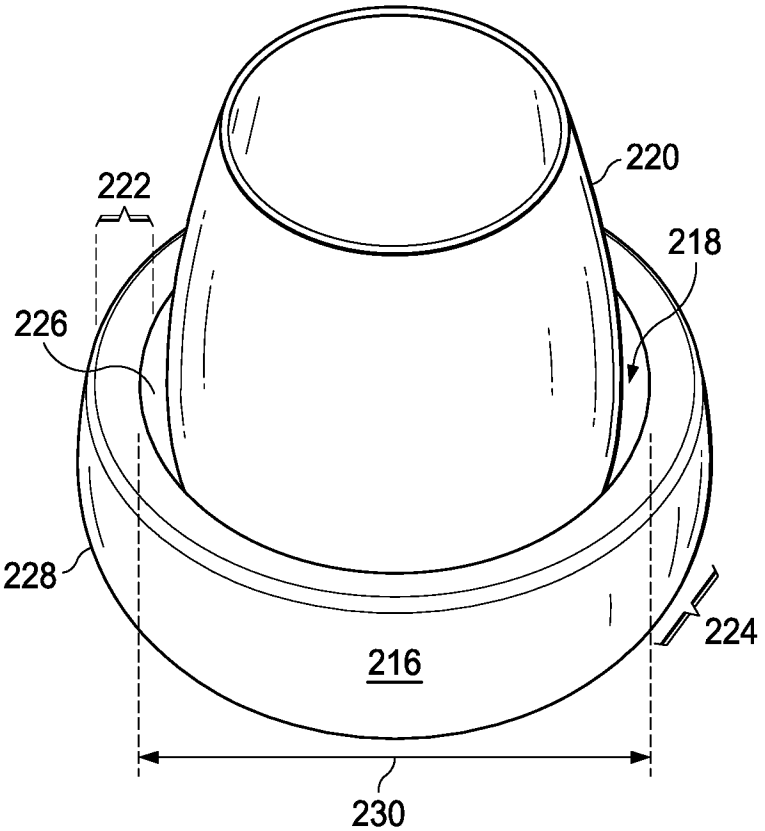
FIG. 12A is a schematic diagram of a system for controlling the temperature of a drink with a receptacle holding a stemless drinking vessel.

FIG. 12B depicts the system and drinking vessel 220 of FIG. 12A, when the receptacle 216 is not holding the drinking vessel 220. The inner wall portion 226, recess 218, and top opening 230 are viewable.

Figure 13:
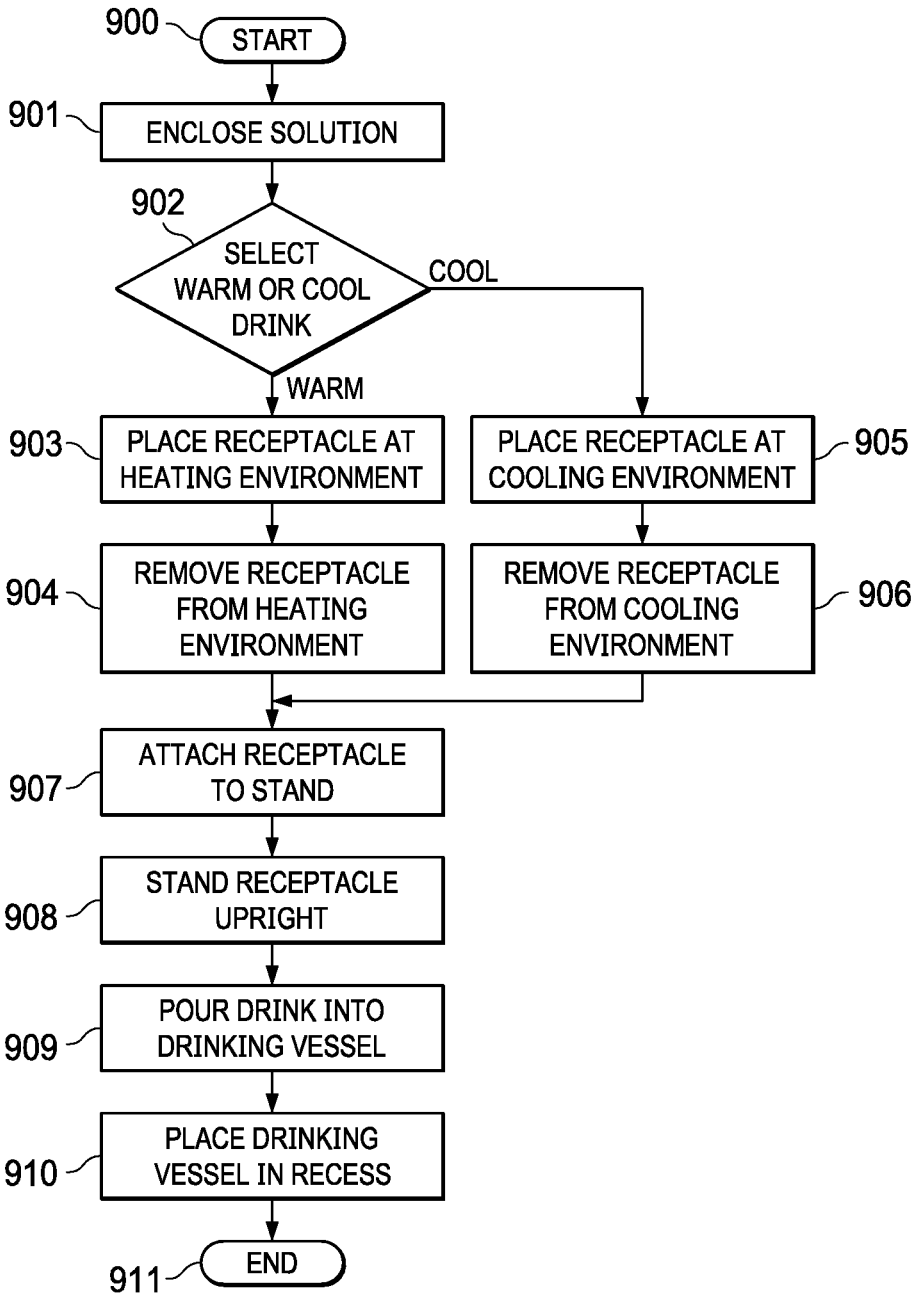
FIG. 13 is a flow chart of a method for controlling the temperature of a drink.

Disclosed herein are methods to control a temperature of a drink. The methods allow for better enjoyment of the drink by the user by enabling viewing of the drink, saving space, and efficiently controlling the drink's temperature. FIG. 13 is a flow chart of an exemplary method for controlling the temperature of a drink. The method may use components and systems as described elsewhere in this disclosure. For example, the method may use the receptacle, stand, receptacle and stand, or system as described with respect to FIGS. 1A through 12B. After starting the controlling of the temperature at step 900, the method includes enclosing a liquid solution in an inner cavity of a receptacle at step 901. Enclosing a solution allows for better and longer thermal transfer. The method includes selecting whether a warm or cool drink is desired at step 902. If a warm drink is selected, the method includes placing a receptacle at a heating environment at step 903. The heating environment may be any environment where the temperature is above room temperature, such as an oven, microwave, or heat lamp. The method includes removing the receptacle from the heating environment at step 904. If a cool drink is selected, the method includes placing a receptacle at a cooling environment at step 905. The cooling environment may be any environment where the temperature is below room temperature, such as a freezer or refrigerator. The method includes removing the receptacle from the cooling environment at step 906.

The method includes attaching the receptacle to a stand at step 907. The method includes standing the receptacle upright at step 908. The receptacle may be stood at step 908 by placing a stand releasably attached to the receptacle on a surface. The receptacle may be stood at step 908 by standing the receptacle upright without a stand on a supporting surface such as a tabletop or the ground outdoors. The receptacle may be stood at step 908 by inserting into the earth a stand with a pointed end releasably attached to the receptacle. The method includes pouring a drink into a drinking vessel at step 909. The method includes placing the drinking vessel into a recess defined by the receptacle at step 910. The method may additionally include fine-tuning the temperature of the drink. For example, the method may include lifting the drinking vessel from the recess defined by the receptacle so as to let the drink warm or cool slightly. The method includes ending the controlling of the temperature at step 911.

The methods offer numerous advantages over previous methods. The methods may allow the user to save space in a cooling or heating environment by storing only the receptacle in the cooling or heating environment. The methods may allow the user to store only the receptacle in the cooling or heating environment therefore allowing the stand to remain at a comfortable temperature for the user to handle. The methods may allow a user to enjoy a temperature-controlled drink while using their own drinking vessel. The methods may further allow the user to view their drink while controlling the drink's temperature. The methods may allow a user to control the temperature of a drink without inserting an object into the drink. The methods may also allow a user to control the temperature of drinks in a variety of different drinking vessels with different shapes.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description.

The invention claimed is:

1. A system for controlling the temperature of a drink, the system comprising:

a receptacle defining a recess for receiving a drinking vessel; and a stand for holding the receptacle upright, the stand releasably attached to the receptacle, wherein:

the receptacle comprises a top end portion, a bottom end portion, an inner wall portion, and an outer wall portion, the bottom end portion including a bottom opening of the recess that is along the inner wall portion and through the bottom end portion, the top end portion defining a top opening of the recess, wherein the receptacle defines a side opening, the side opening i) extending laterally from the inner wall portion to the outer wall portion, and ii) extending vertically from the top opening of the recess to the bottom opening of the recess, wherein the bottom end portion of the receptacle further includes a lip extending outwardly from the receptacle and positioned opposite to the side opening, the lip routing condensation from the receptacle to the stand.

2. The system of claim 1, wherein the drinking vessel is a stemless drinking vessel.

3. The system of claim 1, wherein the inner wall portion comprises a multivessel contour, the multivessel contour comprising:

a top incline having a top slope;

a middle incline having a middle slope, wherein the magnitude of the middle slope is less than the magnitude of the top slope;

a bottom incline, the bottom incline connected to the middle incline; and a curved surface connecting the top incline to the middle incline.

4. The system of claim 1, wherein:

the receptacle defines an inner cavity; the bottom end portion defines a bottom boundary of the inner cavity;

the top end portion defines a top boundary of the inner cavity; the inner wall portion defines an inner boundary of the inner cavity; and the outer wall portion defines an outer boundary of the inner cavity.

5. The system of claim 4, wherein the inner cavity carries and contains a liquid solution.

6. The system of claim 1, wherein the lip includes a single peak.

7. The system of claim 1, wherein the lip includes two or more peaks.

8. A system for controlling the temperature of a drink, the system comprising:

a receptacle defining a recess for receiving a drinking vessel; and a stand for holding the receptacle upright, the stand releasably attached to the receptacle, wherein:

the receptacle comprises a top end portion, a bottom end portion, an inner wall portion, and an outer wall portion, the bottom end portion including a bottom opening of the recess that is along the inner wall portion and through the bottom end portion, the top end portion defining a top opening of the recess; and wherein the bottom end portion of the receptacle further includes a lip extending outwardly from the receptacle, the lip routing condensation from the receptacle to the stand.

9. The system of claim 8, wherein the drinking vessel is a stemless drinking vessel.

10. The system of claim 8, wherein the inner wall portion comprises a multivessel contour, the multivessel contour comprising:

a top incline having a top slope;

a middle incline having a middle slope, wherein the magnitude of the middle slope is less than the magnitude of the top slope;

a bottom incline, the bottom incline connected to the middle incline; and a curved surface connecting the top incline to the middle incline.

11. The system of claim 8, wherein:

the receptacle defines an inner cavity; the bottom end portion defines a bottom boundary of the inner cavity;

the top end portion defines a top boundary of the inner cavity; the inner wall portion defines an inner boundary of the inner cavity; and the outer wall portion defines an outer boundary of the inner cavity.

12. The system of claim 11, wherein the inner cavity carries and contains a liquid solution.

13. The system of claim 8, wherein the lip includes a single peak.

14. The system of claim 8, wherein the lip includes two or more peaks.

15. A system for controlling the temperature of a drink, the system comprising:

a receptacle comprising a top end portion, a bottom end portion, an inner wall portion, and an outer wall portion, wherein:

the receptacle defines a recess for receiving a drinking vessel, wherein the bottom end portion includes a bottom opening of the recess that is along the inner wall portion and through the bottom end portion; and the top end portion defines a top opening of the recess, wherein the bottom end portion of the receptacle further includes a lip extending outwardly from the receptacle, the lip routing condensation from the receptacle to the stand.

16. The system of claim 15, wherein the drinking vessel is a stemless drinking vessel.

17. The system of claim 15, wherein:

the receptacle defines an inner cavity;

the bottom end portion defines a bottom boundary of the inner cavity;

the top end portion defines a top boundary of the inner cavity;

the inner wall portion defines an inner boundary of the inner cavity; and the outer wall portion defines an outer boundary of the inner cavity.

18. The system of claim 17, wherein the inner cavity carries and contains a liquid solution.

19. The system of claim 15, wherein the lip includes a single peak.

20. The system of claim 15, wherein the lip includes two or more peaks.

* * * * *